US009964872B2

(12) United States Patent
Kamikura et al.

(10) Patent No.: US 9,964,872 B2
(45) Date of Patent: May 8, 2018

(54) TONER AND METHOD FOR PRODUCING THE SAME

(71) Applicant: CANON KABUSHIKI KAISHA, Tokyo (JP)

(72) Inventors: Kenta Kamikura, Yokohama (JP); Kunihiko Nakamura, Gotemba (JP); Tsutomu Shimano, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/051,020

(22) Filed: Feb. 23, 2016

(65) Prior Publication Data

US 2016/0246193 A1 Aug. 25, 2016

(30) Foreign Application Priority Data

Feb. 25, 2015 (JP) ..... 2015-035864

(51) Int. Cl.

| | |
|---|---|
| ***G03G 9/087*** | (2006.01) |
| ***G03G 9/08*** | (2006.01) |
| ***G03G 9/09*** | (2006.01) |

(52) U.S. Cl.

CPC ..... *G03G 9/0821* (2013.01); *G03G 9/0804* (2013.01); *G03G 9/0806* (2013.01); *G03G 9/08711* (2013.01); *G03G 9/08755* (2013.01); *G03G 9/092* (2013.01); *G03G 9/0904* (2013.01); *G03G 9/0926* (2013.01)

(58) Field of Classification Search

CPC ..... G03G 9/08755; G03G 9/08711; G03G 9/0821; G03G 9/0904; G03G 9/092; G03G 9/0926; G03G 9/0804; G03G 9/0806

USPC ..... 430/109.3, 109.4

See application file for complete search history.

(56) References Cited

U.S. PATENT DOCUMENTS

| | | | | |
|---|---|---|---|---|
| 7,981,583 | B2 * | 7/2011 | Sasaki | C08G 63/199 399/222 |
| 2015/0153669 | A1 * | 6/2015 | Yoshida | G03G 9/0804 430/109.3 |

FOREIGN PATENT DOCUMENTS

| | | | |
|---|---|---|---|
| JP | 2003-255606 | A | 9/2003 |
| JP | 2006-106727 | A | 4/2006 |
| JP | 2012-78423 | A | 4/2012 |
| JP | 2012-177763 | A | 9/2012 |
| JP | 2014-178397 | A | 9/2014 |
| JP | 2015-040912 | A * | 3/2015 |

OTHER PUBLICATIONS

Japanese Patent Office J-Plat-Pat machine-assisted English-language translation of JP 2015-040912 A (pub. Mar. 2015).*

* cited by examiner

*Primary Examiner* — Janis L Dote

(74) *Attorney, Agent, or Firm* — Canon U.S.A., Inc. IP Division

(57) ABSTRACT

A toner including toner particles containing a binder resin, a pigment, a crystalline resin and an amorphous resin. The adsorption rate A1 of the crystalline resin to the pigment is from 5% to 40%, and the adsorption rate A2 of the amorphous resin to the pigment is from 20% to 60%. The adsorption rates A1 and A2 satisfy relationship (1): A1<A2. The degree of compatibility expressed by equation (2) is 70% or less:

$$\text{Degree of compatibility (\%)}=(1-B1/B2)\times 100 \quad (2)$$

16 Claims, No Drawings

TONER AND METHOD FOR PRODUCING THE SAME

BACKGROUND OF THE INVENTION

Field of the Invention

The present disclosure relates to a toner used in a recording method such as an electrophotographic method, an electrostatic recording method, a magnetic recording method, or a toner jet method, and to a method for producing the toner.

Description of the Related Art

The printing speed of electrophotographic laser printers and copy machines have dramatically been increased. Accordingly, a toner superior in low-temperature fixability and durability is demanded. The quality of printed articles has also been being improved and accordingly, higher tinting strength is demanded of toners.

Toners, including toner particles containing a crystalline resin that can melt at a low temperature, have been studied for improving the low-temperature fixability of the toner. Japanese Patent Laid-Open No. 2006-106727 discloses a suspension-polymerized toner whose toner particles contain a crystalline resin that is present at the surfaces of the particles. Also, Japanese Patent Laid-Open No. 2014-178397 discloses a toner whose toner particles contain a crystalline resin and a noncrystalline resin that forms shells present at the surfaces of the particles.

The toner disclosed in Japanese Patent Laid-Open No. 2006-106727 exhibits both a satisfactory low-temperature fixability and a high tinting strength. The durability thereof is however insufficient in some of the electrophotographic processes where the process speed is as high as, or more than, 200 mm/s, and there is still room for improvement. Although the toner disclosed in Japanese Patent Laid-Open No. 2014-178397 has a satisfactory durability, the tinting strength or the low-temperature fixability may be reduced in some cases depending on the pigment used, and there is also room for improvement.

SUMMARY OF THE INVENTION

The present disclosure provides a toner that can exhibit a satisfactory low-temperature fixability and durability even in a high-speed electrophotographic process and has a high tinting strength.

According to an aspect of the present disclosure, there is provided a toner including toner particles containing a binder resin, a pigment, a crystalline resin and an amorphous resin. The adsorption rate A1 of the crystalline resin to the pigment is in the range of from 5% to 40%, and the adsorption rate A2 of the amorphous resin to the pigment is in the range of from 20% to 60%. The adsorption rates A1 and A2 satisfy the following relationship (1): A1<A2.

In relationship (1), the adsorption rate A1 of the crystalline resin is the value measured for a mixture obtained by mixing 0.1 mass part of the crystalline resin, 1.0 mass part of the pigment, and 20 mass parts of a solvent in which 16 mass parts of styrene and 4 mass parts of n-butyl acrylate are mixed. The adsorption rate A2 of the amorphous resin is the value measured for a mixture obtained by mixing 0.1 mass part of the amorphous resin, 1.0 mass part of the pigment, and 20 mass parts of a solvent in which 16 mass parts of styrene and 4 mass parts of n-butyl acrylate are mixed. The degree of compatibility expressed by the following equation (2) is 70% or less:

$$\text{Degree of compatibility (\%)}=(1-B1/B2)\times 100 \quad (2)$$

In equation (2), B1 represents an exothermic quantity per gram (J/° C.) of the crystalline resin at an exothermic peak derived from the crystallization of the crystalline resin, measured with a differential scanning calorimeter in a secondly cooling step of a process including: heating a resin mixture containing the amorphous resin and the crystalline resin with a mass ratio of 9:1 from 30° C. to 200° C.; subsequently cooling the resin mixture from 200° C. to 0° C.; subsequently heating the resin mixture from 0° C. to 120° C.; then keeping the resin mixture at 120° C. for 5 minutes; and secondly cooling the resin mixture from 120° C. to 0° C. B2 represents an exothermic quantity per gram (J/° C.) of the crystalline resin at an exothermic peak derived from the crystallization of the crystalline resin, measured with a differential scanning calorimeter in a secondly cooling step of a process including: heating the crystalline resin alone from 30° C. to 200° C.; subsequently cooling the crystalline resin from 200° C. to 0° C.; subsequently heating the crystalline resin from 0° C. to 120° C.; then keeping the crystalline resin at 120° C. for 5 minutes; and secondly cooling the crystalline resin from 120° C. to 0° C. In the processes for measuring B1 and B2, the cooling and the heating are each performed at a rate of 10° C./min.

According to another aspect of the present disclosure, there is provided a method for producing the toner containing the toner particles, including one of the following steps (A) and (B):

(A) including preparing a suspension for granulation by forming particles of a composition containing a polymerizable monomer, the crystalline resin, the amorphous resin and the pigment in an aqueous medium, and polymerizing the polymerizable monomer in the suspension; and (B) including preparing a resin solution by dissolving or dispersing a binder resin, the crystalline resin, the amorphous resin and the pigment in an organic solvent, granulating the resin solution by dispersing the resin solution in an aqueous medium; and removing the organic solvent from the particles.

According to still another aspect of the present disclosure, a toner including toner particles containing a polyester resin and a pigment is provided. The polyester resin has a unit derived from an alcohol having an adamantane structure or a unit derived from a carboxylic acid having an adamantane structure, in at least one of the main chain and a side chain thereof. The polyester resin has a weight average molecular weight in the range of 3000 to 35000.

The toner of the present disclosure exhibits a satisfactory low-temperature fixability and durability even in a high-speed electrophotographic process and has a high tinting strength.

Further features of the present disclosure will become apparent from the following description of exemplary embodiments.

DESCRIPTION OF THE EMBODIMENTS

The toner according to a first embodiment of the present disclosure includes toner particles containing a binder resin, a pigment, a crystalline resin and an amorphous resin. The toner has the following two features: First, the adsorption rate A1 of the crystalline resin to the pigment is in the range of from 5% to 40%, the adsorption rate A2 of the amorphous resin to the pigment is in the range of from 20% to 60%, and the adsorption rates A1 and A2 satisfy the following relationship (1): A1<A2.

Second, the degree of compatibility expressed by the following equation (2) is 70% or less:

$$\text{Degree of compatibility (\%)}=(1-B1/B2)\times 100 \quad (2)$$

In relationship (1), the adsorption rate A1 of the crystalline resin is the value measured by using a mixture of 0.1 mass part of the crystalline resin, 1.0 mass part of the pigment, and 20 mass parts of a solvent prepared by mixing styrene and n-butyl acrylate with a mass ratio of 4:1 (16 mass parts of styrene and 4 mass parts of n-butyl acrylate). The adsorption rate A2 of the amorphous resin is the value measured by using a mixture of 0.1 mass part of the amorphous resin, 1.0 mass part of the pigment, and 20 mass parts of a solvent prepared by mixing styrene and n-butyl acrylate with a mass ratio of 4:1 (16 mass parts of styrene and 4 mass parts of n-butyl acrylate).

In equation (2), B1 represents an exothermic quantity (J/g) of the crystalline resin at an exothermic peak derived from the crystallization of the crystalline resin, measured with a differential scanning calorimeter in a secondly cooling step of a process including: heating a resin mixture containing the amorphous resin and the crystalline resin with a mass ratio of 9:1 from 30° C. to 200° C.; subsequently cooling the resin mixture from 200° C. to 0° C.; subsequently heating the resin mixture from 0° C. to 120° C.; then keeping the resin mixture at 120° C. for 5 minutes; and secondly cooling the resin mixture from 120° C. to 0° C.

B2 represents an exothermic quantity (J/g) per gram of the crystalline resin at an exothermic peak derived from the crystallization of the crystalline resin, measured with a differential scanning calorimeter in a secondly cooling step of a process including: heating the crystalline resin alone from 30° C. to 200° C.; subsequently cooling the crystalline resin from 200° C. to 0° C.; subsequently heating the crystalline resin from 0° C. to 120° C.; then keeping the crystalline resin at 120° C. for 5 minutes; and secondly cooling the crystalline resin from 120° C. to 0° C. In the processes for measuring B1 and B2, the cooling and the heating are each performed at a rate of 10° C./min.

The present inventors assume the reason why the toner having these two features overcomes the above-described issues is as below.

In order to improve the durability and tinting strength of a toner including toner particles containing a crystalline resin and a pigment while maintaining the low-temperature fixability thereof, it is important to satisfy the following four:

A first is to control the adsorption rate A1 of the crystalline resin to the pigment. A second is that the toner particles contain an amorphous rein and that the adsorption rate A2 of the amorphous resin to the pigment is controlled. A third is to increase the adsorption rate A1 of the crystalline resin to the pigment compared to the adsorption rate A2 of the amorphous resin to the pigment (to satisfy relationship (1)). A fourth is to control the degree of compatibility (expressed by equation (2)) between the amorphous resin and the crystalline resin.

These four operations will be described in detail below.

The first operation is intended to achieve a high tinting strength of the toner while maintaining the low-temperature fixability and is performed by controlling the adsorption rate A1 of the crystalline resin to the pigment. In order to achieve a satisfactory low-temperature fixability, it is important that the resin of the toner melts at low temperature and can be fixed to the recording medium such as paper, and that the other constituents of the toner are compatible with the melted resin so that the toner is not removed from the recording medium.

In particular, the compatibility between the pigment and the resin should be high. If it is low, the image density of toner-fixed images after rubbing the surface of the recording medium, which is an index of low-temperature fixability, is likely to decrease. Accordingly, a resin easy to adsorb to the pigment is advantageously used. Such a resin can firmly hold the pigment even if the pigment is exposed at the surface of the recording medium. This effect is likely to be produced particularly in the case where the pigment adsorbs the crystalline resin, whose viscosity decreases when the toner is fixed. Hence, the low-temperature fixability of the toner can be improved by increasing the adsorption rate A1 of the crystalline resin to the pigment, and it is important that the adsorption rate A1 is 5% or more. The crystalline resin is however crystallized in the toner particles. If an excessive amount of the crystalline resin adsorb to the pigment, the crystallization of the crystalline resin causes the pigment particles to aggregate, thus reducing the tinting strength. From the viewpoint of increasing the tinting strength, the adsorption rate of the crystalline resin to the pigment should not be too high. It is important that adsorption rate A1 is 40% or less.

Accordingly, when the adsorption rate A1 of the crystalline resin to the pigment is in the range of from 5% to 40%, the low-temperature fixability and coloring power of the toner can be increased.

The second operation is intended to increase the tinting strength of the toner. From this viewpoint, the toner particles of the toner contain an amorphous resin, and the adsorption rate A2 of the amorphous resin to the pigment is controlled.

The contact among the surfaces of pigment particles can be reduced by the adsorption of the amorphous resin to the pigment. Hence, the dispersibility of the pigment can be increased by appropriate adsorption of the amorphous resin to the pigment, and it is important that the adsorption rate A2 of the amorphous resin to the pigment is 20% or more. If adsorption rate A2 is excessively increased, however, the amorphous resin cross-links among the pigment particles, thereby reducing the tinting strength. Adsorption rate A2 is therefore controlled to 60% or less.

Accordingly, when the adsorption rate A2 of the amorphous resin to the pigment is in the range of from 20% to 60%, the tinting strength of the toner increases.

Also, when the adsorption rate A2 of the amorphous resin to the pigment is in the range from 20% to 50%, the amorphous resin does not easily cross-link among the pigment particles, and this is advantageous.

The third operation performed to satisfy relationship (1) increases the coloring power of the toner. As mentioned in the description of the first and second operations, the adsorption of the crystalline resin to the pigment leads to a reduced tinting strength, while an appropriate adsorption of the amorphous resin to the pigment leads to an increased tinting strength. The present inventors expect that a high coloring power of the toner can be achieved by controlling the adsorption rates A1 and A2 to satisfy relationship (1) so that the amorphous resin can be appropriately adsorbed to the pigment while the adsorption of the crystalline resin to the pigment is minimized. When adsorption rates A1 and A2 satisfy relationship (1), the amorphous resin is more likely to adsorb to the pigment than the crystalline resin. Thus, the decrease in tinting strength resulting from the adsorption of the crystalline resin to the pigment is suppressed, while the increase in dispersibility of the pigment resulting from the adsorption of the amorphous resin to the pigment is achieved.

In addition, it is advantageous that the adsorption rates A1 and A2 satisfy the following relationship (3): $10 \leq A2-A1 \leq 55$. When relationship (3) holds true, the tinting strength of the toner increases even if the crystalline resin content in the toner is increased. Relationship (3) suggests that the adsorptivity of the amorphous resin to the pigment is much higher than that of the crystalline resin.

The adsorption rates to the pigment of the crystalline resin and amorphous resin can be controlled by controlling the polarities or molecular weights of the crystalline and amorphous resins, and controlling the amounts of pigment-compatible components of the crystalline resin and amorphous resin.

The fourth operation is intended to achieve a high coloring power and durability of the toner, and is performed by controlling the degree of compatibility between the amorphous resin and the crystalline resin (expressed by equation (2)) to be low. More specifically, the degree of compatibility expressed by equation (2) is controlled to 70% or less.

If the degree of compatibility between the amorphous resin and the crystalline resin, expressed by equation (2), is higher than 70%, the crystalline resin well-mixed with the amorphous resin is likely to be present around the pigment particles even though the above-described three operations are performed so that the amorphous resin has adsorbed satisfactorily to the pigment. Accordingly, it tends to be difficult to suppress the aggregation of the pigment particles, which results from the crystallization of the crystalline resin. If the crystalline resin and the amorphous resin are highly compatible with each other, the amorphous resin is softened and, consequently, the durability of the toner deteriorates. However, if the degree of compatibility between the amorphous resin and the crystalline resin is 70% or less, the aggregation of pigment particles resulting from the crystallization of the crystalline resin can be reduced effectively and, thus, the coloring power of the toner can be increased. In addition, the amorphous resin is kept from softening, and accordingly, the durability of the toner increases. Advantageously, the degree of compatibility between the amorphous resin and the crystalline resin is 60% or less.

The degree of compatibility can be controlled by controlling the chemical makeups or molecular weights of the amorphous and crystalline resins.

In a second embodiment of the present disclosure, a toner including toner particles containing a polyester resin and a pigment is provided. The polyester resin has a unit derived from an alcohol (diol) having an adamantane structure or a unit derived from a carboxylic acid having an adamantane structure, in at least one of the main chain and a side chain thereof. The polyester resin has a weight average molecular weight in the range of from 3000 to 35000. Such a polyester resin enables the pigment to be satisfactorily dispersed and has high transparency. Consequently, images having colors over a wide range can be formed. This is probably because the adsorptivity between the resin and the pigment is controlled by introducing an adamantane structure, which does not have an aromatic structure causing π-π interaction, into at least either the main chain or a side chain of the polyester resin. In addition, since the adamantane structure is rigid and less flexible, the contact area with the pigment is estimated to be small.

The weight average molecular weight of the polyester resin is 35000 or less. The molecule of such a polyester resin is unlikely to come into contact with the pigment at two points or more, and the cross-linking of the resin among the pigment particles is thus reduced. Consequently, the dispersibility of the pigment increases. The cross-linking of a resin among pigment particles means that the molecule of the resin adsorbs to two or more pigment particles to form cross-links among pigment particles. The cross-linking of the resin among pigment particles reduces the distances between each pigment particle and thus easily causes the pigment particles to aggregate.

The polyester resin having an adamantane structure improves the triboelectric stability of the toner. Alicyclic structures are less polarizable than aromatic structures and accordingly less hydrophilic. In addition, the adamantane structure is sterically bulky and accordingly acts as a steric hindrance to suppress the adsorption of water to highly polar sites such as an ester bond adjacent to the adamantane structure. Thus, the total water absorption of the resins can be reduced. The present inventors think that changes in chargeability caused by humidity can be suppressed by reducing the water absorption of the resins, expecting that the triboelectric stability of the toner is improved. If the triboelectric stability of the toner is improved, fogging and other problems in images do not occur much even in a high-humidity environment.

In order to form a stable image even after the toner has been used for a long time, the toner must be prevented from being deteriorated by, for example, stress causing the toner particles to crack or chip, or an external additive embedded. In the present embodiment, the polyester having an adamantane structure has a weight average molecular weight of 3000 or more, and this enables the toner to have a high durability. This is probably because the adamantane structure is rigid, and because the molecular weight of the polyester resin is controlled to a weight average molecular weight of 3000 or more.

The unit derived from an alcohol having an adamantane structure or a carboxylic acid having an adamantane structure may be a unit derived from a compound expressed by the following formula (A-3):

(A-3)

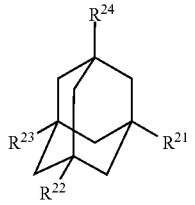

In formula (A-3), at least two of $R^2$ to $R^{24}$ each represent —OH, —COOH, —$R^{25}$—OH, or —$R^{26}$—COOH. The —COOH and —$R^{26}$—COOH groups each may be any one of a halogenated acyl, an ester and an acid anhydride that are derived from the carboxy group thereof, or may be in the form of an acid anhydride in the molecule. The rest of $R^{21}$ to $R^{24}$ each represent a hydrogen atom, a halogen atom, or an alkyl group. $R^{25}$ and $R^{26}$ represent alkylene groups.

Examples of the compound expressed by formula (A-3) include 1,3-adamantanediol, 1,3-adamantanedimethanol, 1,3-adamantanedicarboxylic acid, 1,3-adamantanediacetic acid, 3-(hydroxymethyl)-1-adamantanol, 1,3,5-adamantanetriol, and 1,3,5-adamantanetricarboxylic acid. Among these 1,3-adamantanediol or 1,3-adamantanedicarboxylic acid is advantageous.

Desirably, the polyester resin has an acid value in the range of from 2.0 mg KOH/g to 15.0 mg KOH/g.

The materials of the toner of the present disclosure will now be described.

Amorphous Resin

Examples of the amorphous resin used in the toner particles of the present disclosure include polyester resin, vinyl resin, polyamide resin, furan resin, epoxy resin, xylene resin, and silicone resin. Polyester resin is suitable because the degree of compatibility thereof with the crystalline resin is easy to control.

The polyester resin may be produced by dehydration condensation of a dibasic acid or a derivative thereof (carboxylic halide, ester, or acid anhydride) and a dihydric alcohol (diol compound). In addition to the dibasic acid or derivative thereof and the dihydric alcohol, the polyester resin may be produced by using a trifunctional or more functional polybasic acid or a derivative thereof (carboxylic halide, ester, or acid anhydride), a monobasic acid, a trifunctional or more functional alcohol, or a monohydric alcohol.

Examples of the dibasic acid include aliphatic dibasic acids, such as maleic acid, fumaric acid, itaconic acid, oxalic acid, malonic acid, succinic acid, dodecylsuccinic acid, dodecenylsuccinic acid, adipic acid, azelaic acid, sebacic acid, and decane-1,10-dicarboxylic acid; aromatic dibasic acids, such as phthalic acid, tetrabromophthalic acid, tetrachlorophthalic acid, isophthalic acid, terephthalic acid, and 2,6-naphthalenedicarboxylic acid; and alicyclic dibasic acids, such as 1,4-cyclohexanedicarboxylic acid, 1,3-cyclohexanedicarboxylic acid, 1,2-cyclohexanedicarboxylic acid, 4-methyl-1,2-cyclohexanedicarboxylic acid, cis-4-cyclohexene-1,2-dicarboxylic acid, cis-1-cyclohexene-1,2-dicarboxylic acid, norbornanedicarboxylic acid, norbornenedicarboxylic acid, and 1,3-adamantanedicarboxylic acid. Examples of the derivatives of dibasic acids include carboxylic halides, esters and acid anhydrides of the above-cited aliphatic, aromatic or alicyclic dibasic acids.

Examples of the dihydric alcohol (diol compound) include aliphatic diols (noncyclic aliphatic diols), such as ethylene glycol, 1,2-propylene glycol, 1,4-butanediol, 1,5-pentanediol, 1,6-hexanediol, diethylene glycol, dipropylene glycol, triethylene glycol, and neopentyl glycol; bisphenols, such as bisphenol A and bisphenol F; bisphenol A alkylene oxide adducts, such as bisphenol A ethylene oxide adduct and bisphenol A propylene oxide adduct; aralkylene glycols, such as xylylene diglycol; and alicyclic diols, such as 1,4-cyclohexanedimethanol, isosorbide, spiroglycol, hydrogenated bisphenol A, 1,4-cyclohexanediol, 1,2-cyclohexanediol, 1,3-cyclohexanediol, 4-(2-hydroxyethyl)cyclohexanol, 4-(hydroxymethyl)cyclohexanol, 4,4'-bicyclohexanol, and 1,3-adamantanediol.

Trifunctional or more functional polybasic acids and anhydrides thereof include trimellitic acid, trimellitic anhydride, 1,3,5-cyclohexanetricarboxylic acid, 1,2,4-cyclohexanetricarboxylic acid, 1,2,4,5-cyclohexanetetracarboxylic acid, 1,2,3,4,5,6-cyclohexanehexacarboxylic acid, methylcyclohexenetricarboxylic acid, methylcyclohexenetricarboxylic anhydride, pyromellitic acid, and pyromellitic dianhydride.

The amorphous resin is desirably a polyester resin having a unit derived from an alcohol (diol) having an alicyclic structure or a unit derived from a carboxylic acid having an alicyclic structure, in at least one of the main chain and a side chain thereof. The use of such a resin facilitates the control of both the degree of compatibility expressed by equation (2) and the adsorption rate A2 of the amorphous resin.

The ratio of the amount by mole of the units derived from an alcohol having an alicyclic structure or a carboxylic acid having an alicyclic structure to the amount by mole of all the units of the polyester resin is desirably in the range of from 0.1% to 50%. Such a polyester resin exhibits high rigidity as a whole, accordingly increasing the durability of the toner.

The alicyclic structure refers to a cyclic structure that is not aromatic. It may be an alicyclic hydrocarbon structure whose cyclic structure consists of only carbon and hydrogen atoms, or an alicyclic heterocyclic structure whose cyclic structure contains an element other than carbon and hydrogen. An alicyclic hydrocarbon structure is more advantageous. Amorphous resins having an alicyclic hydrocarbon structure do not much affect the degree of compatibility with the crystalline resin and whose adsorption rate to the pigment can be low.

The unit derived from an alcohol having an alicyclic structure or a carboxylic acid having an alicyclic structure may be a unit derived from a compound expressed by any one of the following formulas (A-1) to (A-5):

(A-1)

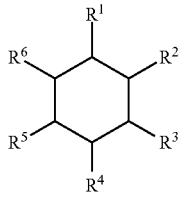

(A-2)

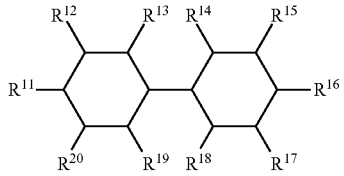

(A-3)

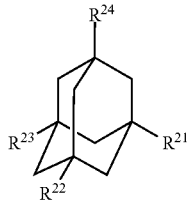

(A-4)

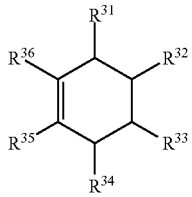

(A-5)

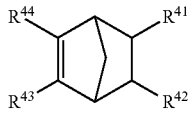

In formula (A-1), at least two of $R^1$ to $R^6$ each represent —OH, —COOH, —$R^7$—OH, or —$R^8$—COOH. The —COOH and —$R^8$—COOH groups each may be any one of a halogenated acyl, an ester and an acid anhydride that are derived from the carboxy group thereof, or may be in the form of an acid anhydride in the molecule. The rest of $R^1$ to $R^6$ each represent a hydrogen atom, a halogen atom, or an alkyl group. $R^7$ and $R^8$ represent alkylene groups.

In formula (A-2), at least two of $R^{11}$ to $R^{20}$ each represent —OH, —COOH, —$R^9$—OH, or —$R^{10}$—COOH. The —COOH and —$R^{10}$—COOH groups each may be any one of a halogenated acyl, an ester and an acid anhydride that are derived from the carboxy group thereof, or may be in the form of an acid anhydride in the molecule. The rest of $R^{11}$ to $R^{20}$ each represent a hydrogen atom, a halogen atom, or an alkyl group. $R^9$ and $R^{10}$ represent alkylene groups.

In formula (A-3), at least two of $R^{21}$ to $R^{24}$ each represent —OH, —COOH, —$R^{25}$—OH, or —$R^{26}$—COOH. The —COOH and —$R^{26}$—COOH groups each may be any one of a halogenated acyl, an ester and an acid anhydride that are derived from the carboxy group thereof, or may be in the form of an acid anhydride in the molecule. The rest of $R^{21}$ to $R^{24}$ each represent a hydrogen atom, a halogen atom, or an alkyl group. $R^{25}$ and $R^{26}$ represent alkylene groups.

In formula (A-4), at least two of $R^{31}$ to $R^{36}$ each represent —OH, —COOH, —$R^{37}$—OH, or —$R^{38}$—COOH. The —COOH and —$R^{38}$—COOH groups each may be any one of a halogenated acyl, an ester and an acid anhydride that are derived from the carboxy group thereof, or may be in the form of an acid anhydride in the molecule. The rest of $R^{31}$ to $R^{36}$ each represent a hydrogen atom, a halogen atom, or an alkyl group. $R^{37}$ and $R^{39}$ represent alkylene groups.

In formula (A-5), at least two of $R^{41}$ to $R^{44}$ each represent —OH, —COOH, —$R^{45}$—OH, or —$R^{46}$—COOH. The —COOH and —$R^{46}$—COOH groups each may be any one of a halogenated acyl, an ester and an acid anhydride that are derived from the carboxy group thereof, or may be in the form of an acid anhydride in the molecule. The rest of $R^{41}$ to $R^{44}$ each represent a hydrogen atom, a halogen atom, or an alkyl group. $R^{45}$ and $R^{46}$ represent alkylene groups.

Examples of the monomer having an alicyclic hydrocarbon structure include the above cited alicyclic dibasic acids and other acid monomers, such as 1,3,5-cyclohexanetricarboxylic acid, 1,2,4-cyclohexanetricarboxylic acid, 1,2,4,5-cyclohexanetetracarboxylic acid, 1,2,3,4,5,6-cyclohexanehexacarboxylic acid, and methylcyclohexenetricarboxylic acid. Examples of the alcohol monomer include 1,4-cyclohexanedimethanole cited above, hydrogenated bisphenol A, 1,4-cyclohexanediol, 1,2-cyclohexanediol, 1,3-cyclohexanediol, 4-(2-hydroxyethyl)cyclohexanol, 4-(hydroxymethyl)cyclohexanol, 4,4'-bicyclohexanol, and 1,3-adamantanediol. Examples of the monomer having an alicyclic heterocyclic structure include isosorbide and spiroglycol, which have been cited as examples of the dihydric alcohol (diol compound).

The side chains of the polyester resin mentioned herein refer to those defined as branch, side-chain, or pendant chain in the Glossary of the Society of Polymer Science, Japan, and do not include pendant group or side-group.

More specifically, the side chains are those defined in Definition 1. 53 in the Glossary as an oligomeric or polymeric offshoot from a macromolecular chain. The pendant group or side-group is defined as an offshoot, neither oligomeric nor polymeric, from a chain in Definition 1. 56 in the Glossary. Hence, the side chains mentioned herein have a repeating unit as with the main chain.

Advantageously, the amorphous resin has a weight average molecular weight in the range of from 5000 to 50000 from the viewpoint of obtaining satisfactory durability and fixability. More advantageously, the weight average molecular weight of the amorphous resin is in the range of from 7500 to 30000.

Advantageously, the amorphous resin has an acid value in the range of from 2.0 mg KOH/g to 20.0 mg KOH/g from the viewpoint of improving triboelectric chargeability. More advantageously, it is in the range of from 2.0 mg KOH/g to 15.0 mg KJOH/g.

The proportion of the amorphous resin may be in the range of 1 mass part to 20 mass parts relative to 100 mass parts of the binder resin.

Crystalline Resin

The crystalline resin used in the toner particles of the present disclosure may be a crystalline polyester resin, a crystalline polyurethane resin, or a crystalline acrylic resin. Crystalline polyester resins are advantageous because the degree of compatibility thereof with the amorphous resin (the degree of compatibility expressed by equation (2)) is easy to control. Among crystalline polyester resins, desirable are those produced by a reaction between an aliphatic diol and an aliphatic dicarboxylic acid, each having a carbon number of 4 to 20. Examples of the aliphatic diol include 1,4-butanediol, 1,5-pentanediol, 1, 6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. An aliphatic diol having a double bond may be used. Examples of the aliphatic diol having a double bond include 2-butene-1,4-diol, 3-hexene-1,6-diol, and 4-octene-1,8-diol.

Examples of the aliphatic dicarboxylic acid include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid. Lower alkyl esters or acid anhydrides of these aliphatic dicarboxylic acids may also be use. Furthermore, dicarboxylic acids having a double bond may be used, such as fumaric acid, maleic acid, 3-hexenedioic acid, and 3-octenedioic acid. Lower alkyl esters or acid anhydrides of these dicarboxylic acids may be used.

Advantageously, the crystalline resin has a weight average molecular weight in the range of from 5000 to 100000. More advantageously, the weight average molecular weight of the crystalline resin is in the range of from 7500 to 50000 from the viewpoint of increasing fixability and coloring power.

Advantageously, the crystalline resin has an acid value in the range of from 0.0 mg KOH/g to 10.0 mg KOH/g from the viewpoint of improving triboelectric chargeability.

The melting point of the crystalline resin is desirably from 50° C. to 110° C., and more desirably from 70° C. to 90° C.

The proportion of the crystalline resin may be in the range of 1 mass part to 30 mass parts relative to 100 mass parts of the binder resin.

The crystalline resin mentioned herein refers to a resin exhibiting a clear endothermic peak (melting point) in a curve of reversible specific heat changes obtained by a measurement by differential scanning calorimetry. On the other hand, a resin not exhibiting a clear endothermic peak is defined as an amorphous resin.

Pigment

The pigment may be selected from among the following black pigments, yellow pigments, magenta pigments and cyan pigments.

Exemplary black pigments include carbon blacks.

Exemplary yellow pigments include monoazo compounds, disazo compounds, condensed azo compounds, isoindolinone compounds, isoindoline compounds, benzimidazolone compounds, anthraquinone compounds, azo metal complexes, methine compounds, and allyl amide compounds. More specifically, yellow pigments includes C.I. Pigment Yellows 74, 93, 95, 109, 111, 128, 155, 174, 180, and 185.

Exemplary magenta pigments include monoazo compounds, condensed azo compounds, diketopyrrolopyrrole compounds, anthraquinone compounds, quinacridone compounds, basic dye lakes, naphthol compounds, benzimidazolone compounds, thioindigo compounds, and perylene compounds. More specifically, magenta pigments include C.I. Pigment Reds 2, 3, 5, 6, 7, 23, 48:2, 48:3, 48:4, 57:1, 81:1, 122, 144, 146, 150, 166, 169, 177, 184, 185, 202, 206, 220, 221, 238, 254 and 269, and C.I. Pigment Violet 19.

Exemplary cyan pigments include copper phthalocyanine compounds and derivatives thereof, anthraquinone compounds, and basic dye lakes. More specifically, cyan pigments include C.I. Pigment Blues 1, 7, 15, 15:1, 15:2, 15:3, 15:4, 60, 62, and 66.

Among those, pigments having an aromatic ring in the molecule thereof are advantageous. The use of such a pigment facilitates the control of adsorption rates A1 and A2. A carbon black or a magenta pigment having a quinacridone skeleton are more advantageous.

The proportion of the pigment may be in the range of from 1 mass part to 20 mass parts relative to 100 mass parts of the binder resin.

Binder Resin

The toner particles of the toner of the present disclosure contain a binder resin. Desirably, the binder resin has an adsorption rate A3 to the pigment of 15% or less. Such a binder resin does not inhibit the amorphous resin from adsorbing to the pigment and thus functioning to increase the coloring power of the toner, and further increases the tinting strength. More specifically, adsorption rate A3 is in the range of from 0% to 15%. More desirably it is in the range of from 0% to 10%. Adsorption rate A3 is the value measured for a mixture of 0.1 mass part of the binder resin, 1.0 mass part of the pigment, and 20 mass parts of a solvent in which styrene and n-butyl acrylate are mixed in a 4:1 ratio by mass (16 mass parts of styrene and 4 mass parts of n-butyl acrylate).

Examples of the binder resin used in the toner particles of the present disclosure include vinyl resin, polyester resin, polyamide resin, furan resin, epoxy resin, xylene resin, and silicone resin.

Vinyl resin is advantageous for controlling the A3 value. Examples of the vinyl resin include homopolymers or copolymers of the following monomers: styrene-based monomers, such as styrene, α-methylstyrene, and divinylbenzene; unsaturated carboxylic acid esters, such as methyl acrylate, butyl acrylate, methyl methacrylate, 2-hydroxyethyl methacrylate, t-butyl methacrylate, and 2-ethylhexyl methacrylate; unsaturated carboxylic acids, such as acrylic acid and methacrylic acid; unsaturated dicarboxylic acids, such as maleic acid; unsaturated dicarboxylic anhydrides, such as maleic anhydride; nitrile-based vinyl monomers, such as acrylonitrile; halogen-containing vinyl monomers, such as vinyl chloride; and nitro-based vinyl monomers, such as nitrostyrene. Copolymers of a styrene monomer and an unsaturated carboxylic acid ester are advantageous. These resins are not much compatible with the amorphous resin.

The toner particles of the toner may further contain a releasing agent. Examples of the releasing agent include monofunctional wax esters, such as behenyl behenate, stearyl stearate, and palmityl palmitate; bifunctional wax esters, such as dibehenyl sebacate and hexanediol dibehenate; trifunctional wax esters, such as glycerin tribehenate; tetrafunctional wax esters, such as pentaerythritol tetrastearate and pentaerythritol tetrapalmitate; hexafunctional wax esters, such as dipentaerythritol hexastearate and dipentaerythritol hexapalmitate; polyfunctional wax esters, such as polyglycerin behenate; natural wax esters, such as carnauba wax and rice wax; petroleum waxes, such as paraffin wax, microcrystalline wax, and petrolatum, and derivatives thereof; hydrocarbon waxes produced by Fischer-Tropsch method and derivatives thereof; polyolefin waxes, such as polyethylene wax and polypropylene wax, and derivatives thereof; higher aliphatic alcohols; fatty acids, such as stearic acid and palmitic acid; and acid amide waxes. The monofunctional to hexafunctional wax esters refer to esters of an aliphatic monocarboxylic acid and one of the monohydric to hexahydric alcohols, or esters of an aliphatic monohydric alcohol and one of the monovalent to hexavalent carboxylic acids.

The proportion of the releasing agent may be in the range of from 1 mass part to 30 mass parts relative to 100 mass parts of the binder resin.

The toner particles of the toner may further contain a charge control agent. The charge control agent used in the toner of the present disclosure may be selected from among known charge control agents. Exemplary negative charge control agents include metal compounds of aromatic carboxylic acids, such as salicylic acid, alkylsalicylic acids, dialkylsalicylic acids, and naphthoic acid; homopolymers or copolymers having a sulfonic acid group, a sulfonate group, or a sulfonic acid ester group; metal salts or metal complexes of azo dyes or azo pigments; boron compounds and silicon compounds; and calixarene. Exemplary positive charge control agents include quaternary ammonium salts and polymeric compounds having a quaternary ammonium salt in a side chain thereof; guanidine compounds; nigrosine-based compounds; and imidazole compounds.

Examples of the homopolymers or copolymers having a sulfonate group or a sulfonic acid ester group include homopolymers of a sulfonic acid group-containing vinyl monomer, such as styrenesulfonic acid, 2-acrylamide-2-methylpropanesulfonic acid, 2-methacrylamido-2-methylpropanesulfonic acid, vinylsulfonic acid, or methacrylsulfonic acid; and copolymers of one or more of these sulfonic acid group-containing vinyl monomers and one or more of the vinyl monomers cited as the binder resin.

The proportion of the charge control agent may be in the range of from 0.01 mass part to 5 mass parts relative to 100 mass parts of the binder resin.

The toner particles of the toner may further contain an external additive for improving the fluidity of the toner. The external additive is desirably mixed with the toner particles unmixed with an external additive. The external additive may be selected from among known external additives. Examples of the external additive include bulk silica fine particles, such as wet process silica and dry process silica, and silica fine particles prepared by surface-treating such bulk silica fine particles with a silane coupling agent, a titanium coupling agent, a silicone oil or any other treatment agent; fine particles of metal oxides, such as titanium oxide fine particles, aluminum oxide fine particles, and zinc oxide fine particles, and metal oxide fine particles prepared by hydrophobizing these metal oxide fine particles; fatty acid metal salts, such as zinc stearate and calcium stearate; metal complexes of aromatic carboxylic acids, such as salicylic acid, alkylsalicylic acid, dialkyl salicylic acid, naphthoic acid, and aromatic dicarboxylic acids; fine particles of clay minerals, such as hydrotalcite; and fluorocarbon resin fine particles, such as vinylidene fluoride fine particles and polytetrafluoroethylene fine particles. Among these, silica fine particles prepared by surface-treating bulk silica fine particles are advantageous for increasing the fluidity and triboelectric chargeability of the toner.

The external additive content may be in the range of from 0.1 mass part to 5 mass parts relative to 100 mass parts of the toner particles before being mixed with the external additive.

The method for producing a toner according to an embodiment of the present disclosure will now be described in detail.

The toner may be produced by, for example, suspension polymerization, dissolution suspension, emulsion aggregation, spray drying, or pulverization. A process including the step of performing granulation in an aqueous medium is more advantageous. Such a process forms a core-shell structure whose shell is made of the amorphous resin, thus increasing the durability of the toner. Dissolution suspension and suspension polymerization are known as a process including the step of performing granulation in an aqueous medium. In particular, suspension polymerization allows easy formation of uniform shells and is thus advantageous.

For producing toner particles by suspension polymerization, a polymerizable monomer composition is prepared by uniformly dissolving or dispersing the materials including a polymerizable monomer, an amorphous resin, a crystalline resin and a pigment, and optionally a releasing agent, a charge control agent and other additives. The polymerizable monomer composition is then dispersed in an aqueous medium with a mixer to yield a suspension. Then, the polymerizable monomer in the suspension is polymerized, and thus toner particles having a desired particle size are produced. After the polymerization, the toner particles (before adding the external additive) are filtered, washed and dried by known methods, and are then mixed with an external additive. The toner thus can be produced.

The polymerizable monomer used for producing toner particles by suspension polymerization may be any one of the monomers cited in the description of the binder resin, including styrene monomers, unsaturated carboxylic acid esters, unsaturated carboxylic acids, unsaturated dicarboxylic acids, unsaturated dicarboxylic anhydrides, nitrile-containing vinyl monomers, halogen-containing vinyl monomers, and nitro-based vinyl monomers.

For producing toner particles by suspension polymerization, a polymerization initiator may further be used. The polymerization initiator may be selected from among known polymerization initiators. Exemplary polymerization initiators include azo- or diazo-based polymerization initiators, such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and peroxide-based polymerization initiators, such as benzoyl peroxide, t-butyl peroxy-2-ethylhexanoate, t-butyl peroxypivalate, t-butyl peroxyisobutyrate, t-butyl peroxyneodecanoate, methyl ethyl ketone peroxide, diisopropyl peroxycarbonate, cumene hydroperoxide, 2,4-dichlorobenzoyl peroxide, and lauroyl peroxide.

In the suspension polymerization for producing the toner particles, a known chain transfer agent and a polymerization inhibitor may be further used.

Furthermore, in the suspension polymerization process, an inorganic or organic dispersion stabilizer may be added to the aqueous medium. The dispersion stabilizer may be selected from among known dispersion stabilizer. Exemplary inorganic dispersion stabilizers include phosphates, such as hydroxyapatite, calcium tertiary phosphate, calcium secondary phosphate, magnesium phosphate, aluminum phosphate, and zinc phosphate; carbonates, such as calcium carbonate and magnesium carbonate; metal hydroxides, such as calcium hydroxide, magnesium hydroxide, and aluminum hydroxide; sulfates, such as calcium sulfate and barium sulfate; calcium metasilicate; bentonite; silica; and alumina. Exemplary organic dispersion stabilizers include polyvinyl alcohol, gelatin, methyl cellulose, methyl hydroxypropyl cellulose, ethyl cellulose, carboxymethyl cellulose sodium salt, polyacrylic acid and salts thereof, and starch.

If an inorganic dispersion stabilizer is used, a commercially available product may be used as it is, or any of the above-cited inorganic compounds may be produced as finer particles in an aqueous medium. For example, for producing a calcium phosphate such as hydroxyapatite or calcium tertiary phosphate, an aqueous solution of a phosphate and an aqueous solution of a calcium salt may be mixed with each other with strong agitation.

For producing the toner particles by suspension polymerization, a surfactant may be further added to the aqueous medium. The surfactant may be selected from among known surfactants. Exemplary known surfactants include anionic surfactants, such as sodium dodecylbenzenesulfate and sodium oleate, cationic surfactants, amphoteric surfactants, and nonionic surfactants.

For producing the toner particles by dissolution suspension, a binder resin, a crystalline resin, an amorphous resin and a pigment are dissolved or dispersed in an organic solvent to prepare a resin solution (step of dissolution). Then, the resin solution is dispersed in an aqueous medium to granulate the resin solution (step of granulation). The resulting particles are subjected to the step of removing the organic solvent from the particles, and thus the toner particles are produced. After the removal of the solvent, the toner particles are filtered, washed and dried by known methods, and are then mixed with an external additive. Thus the toner of an embodiment of the present disclosure can be produced.

The organic solvent used for producing the toner particles by dissolution suspension is desirably not miscible with water and easy to remove by heating. For example, ethyl acetate may be used.

Furthermore, in the dissolution suspension process, an inorganic or organic dispersion stabilizer may be added to the aqueous medium. The dispersion stabilizer may be selected from among the dispersion stabilizer cited in the description of the suspension polymerization.

The methods for measuring physical properties of the materials used herein will now be described in detail.

Glass Transition Temperature Tg of Amorphous Resin

The glass transition temperature Tg of the amorphous resin is measured in accordance with ASTM D3418-82 with a differential scanning calorimeter Q1000 (manufacture by TA Instruments). For the temperature compensation of the detector of the calorimeter, the melting points of indium and zinc are used. The amount of heat is corrected using the heat of fusion of indium.

More specifically, 1 mg of the amorphous resin is placed in an aluminum pan. An empty pan is used as a reference. The measurement is performed by raising temperature from 30° C. to 200° C. at a heating rate of 10° C./min. A change in specific heat appears in the range of from 40° C. to 100° C. during this heating operation. The glass transition temperature Tg (° C.) of the amorphous resin is defined by the intersection of the differential thermal curve with the line through the midpoints of the baselines before and after a change in specific heat appears.

Melting Point Tm of Crystalline Resin

The melting point Tm of the crystalline resin is measured in accordance with ASTM D3418-82 with a differential scanning calorimeter Q1000 (manufacture by TA Instruments). For the temperature compensation of the detector of the calorimeter, the melting points of indium and zinc are used. The amount of heat is corrected using the heat of fusion of indium.

More specifically, 1 mg of the crystalline resin is placed in an aluminum pan. An empty pan is used as a reference. The measurement is performed by raising temperature from 30° C. to 200° C. at a heating rate of 10° C./min. In this measurement, the sample is heated to 200° C. once, subsequently cooled to 30° C., and then heated again. In this second heating step, the temperature in the range of from 30° C. to 200° C. at which the highest endothermic peak is exhibited in the DSC curve is defined as the melting point Tm (° C.) of the crystalline resin.

Weight Average Molecular Weights Mw of Amorphous Resin and Crystalline Resin

The weight average molecular weights Mw of the amorphous resin and the crystalline resin are measured by gel permeation chromatography (GPC) as below.

First, the amorphous resin and the crystalline resin are each dissolved in tetrahydrofuran (THF) at room temperature over a time period of 24 hours. The resulting solution is filtered through a solvent-resistant membrane filter "Maishori Disk" of 0.2 μm in pore size (manufacture by Tosoh Corporation) to prepare a sample solution. The sample solution is adjusted so that the content of the constituent soluble in THF will be about 0.8% by mass. The resulting sample solution is subjected to measurement under the following conditions:

Apparatus: HLC 8120 GPC (detector: RI) (manufactured by Tosoh Corporation)

Columns: combination of 7 columns of Shodex series KF-801, KF-802, KF-803, KF-804, KF-805, KF-806 and KF-807 (manufactured by Showa Denko)

Eluent: tetrahydrofuran (THF)

Flow rate: 1.0 mL/min

Oven temperature: 40.0° C.

Volume of sample injected: 0.10 mL

For calculating the molecular weight of the sample, a molecular weight calibration curve is prepared using standard polystyrene resins (for example, TSK Standard Polystyrenes F-850, F-450, F-288, F-128, F-80, F-40, F-20, F-10, F-4, F-2, F-1, A-5000, A-2500, A-1000, and A-500, produced by Tosoh).

Adsorption Rates to Pigment of Crystalline Resin, Amorphous Resin and Binder Resin The adsorption rates to the pigment of the crystalline resin, the amorphous resin and the binder resin are measured by the following procedure:

(1) The following materials and glass beads were weighed out as below and placed in a 50 mL pressure bottle. The weight of the solvent prepared by mixing styrene and n-butyl acrylate as below is 20 g.

Pigment: 1.0 g

Corresponding resin: 0.1 g

Styrene: 16.0 g n-Butyl acrylate: 4.0 g

Glass beads (diameter: 0.8 mm): 30 g (2) The pressure bottle is shaken for 10 hours with a paint shaker (manufactured by Toyo Seiki).

(3) After the shaking, the liquid in the bottle is subjected to separation with a centrifuge Mini Spin Plus (manufactured by Eppendorf) at 14.5 krpm for 30 minutes, and the supernatant liquor is taken out.

(4) The supernatant liquor is filtered through Millex LH 0.45 μm (manufactured by Millipore), and the filtrate is analyzed by gel permeation chromatography (GPC). This analysis is performed under the same conditions as the measurements of weight average molecular weights Mw of the amorphous resin and the crystalline resin. The peak area in the chart of the analysis (vertical axis: electrical intensity dependent on the concentration of the resin; horizontal axis: retention time) is represented as S1. The vertical axis may be any other index dependent on the concentration of the resin.

(5) Similarly, the mixture of the following materials is filtered through Millex LH 0.45 μm (manufactured by Millipore), and the filtrate is analyzed by GPC. The peak area in the chart of the analysis is represented as S2. In order to obtain the peak area ratio of S1 to S2, the charts prepared for obtaining the peak areas S1 and S2 have the same scales on the horizontal and vertical axes.

Corresponding resin: 0.1 g

Styrene: 16.0 g n-Butyl acrylate: 4.0 g (6) The adsorption rates to the pigment of the resins are calculated using the following equation:

$$\text{Adsorption rate (\%)}=(1-S1/S2)\times 100$$

Degree of Compatibility between Amorphous Resin and Crystalline Resin

The degree of compatibility between the amorphous resin and the crystalline resin is measured by the following procedure:

(1) The following materials are weighed out as below and placed in a 8 mL glass bottle.

Amorphous resin: 0.45 g (450 mg)

Crystalline resin: 0.05 g (50 mg)

Tetrahydrofuran (THF): 3 mL (2) The mixture of the amorphous resin and the crystalline resin is heated to a temperature higher than or equal to the melting point of the crystalline resin to prepare a resin composition, and the resin composition is dissolved in THF to yield a resin solution.

(3) The resin solution is dropped onto an aluminum pan whose mass has been measured in advance, and is heated to remove the THF on a hot plate of 180° C. for 1 hour.

(4) After the removal of the THF, the mass of the pan is measured again, and the mixture (of the crystalline resin and the amorphous resin) is ensured to be in the range from 0.5 mg to 1.5 mg.

(5) The mixture is heated from 30° C. to 200° C. at a heating rate of 10° C./min with a differential scanning calorimeter Q1000 (manufactured by TA Instruments), and subsequently cooled from 200° C. to 0° C. at a cooling rate of 10° C./min. Subsequently, the mixture is heated from 0° C. to 120° C. at a heating rate of 10° C./min, held at 120°

C. for 5 minutes, and then cooled from 120° C. to 0° C. at a cooling rate of 10° C./min (secondly cooling). Using the exothermic peak in the chart of the secondly cooling step is calculated the endothermic quantity B1 (J/g) of the crystalline resin at the exothermic peak derived from the crystallization of the crystalline resin in the resin mixture.

(6) In an aluminum pan is added 1 mg of the crystalline resin alone, and the same operation as (5) is performed with a differential scanning calorimeter Q1000 (manufactured by TA Instruments). Then the endothermic quantity B2 (J/g) of the crystalline resin at the exothermic peak derived from the crystallization of the crystalline resin alone is calculated in the same manner as in (5).

(7) The degree of compatibility between the amorphous resin and the crystalline resin is calculated using the following equation (2):

$$\text{Degree of compatibility (\%)}=(1-B1/B2)\times 100 \quad (2)$$

Acid Values of Amorphous Resin and Crystalline Resin

The acid values of the amorphous resin and the crystalline resin are measured by the following procedure.

The acid value of a sample refers to the milligrams of potassium hydroxide required to neutralize the acid contained in 1 g of the sample. The acid values of the amorphous resin and the crystalline resin are measured in accordance with JIS K 0070-1992, specifically as below.

(1) Preparation of Regent

A phenolphthalein solution is prepared by dissolving 1.0 g of phenolphthalein in 90 mL of ethyl alcohol (95 vol %) and adding ion exchanged water up to a total volume of 100 mL. In 5 mL of water, 7 g of highest-quality potassium hydroxide is dissolved, and ethyl alcohol (95 vol %) is added up to a total volume of 1 L. The mixture is allowed to stand for 3 days in an alkali-resistant container so as not to come into contact with carbon dioxide. Then, the mixture is filtered to yield a potassium hydroxide solution. The resulting potassium hydroxide solution is stored in an alkali-resistant container. The factor of the potassium hydroxide solution is determined from the amount of the potassium hydroxide solution used for titration for neutralizing 25 mL of 0.1 mol/L hydrochloric acid solution in a conical flask to which some droplets of the phenolphthalein solution has been added. The 0.1 mol/L hydrochloric acid solution is prepared in accordance with JIS K 8001-1998.

(2) Operation (A) Titration

To 2.0 g of pulverized amorphous resin or crystalline resin sample accurately weighed out in a 200 mL conical flask, 100 mL of toluene/ethanol (2:1) mixed solution is added, and the sample is dissolved over a period of 5 hours. Subsequently, some droplets of the phenolphthalein solution are added as an indicator, and the resulting solution is titrated with the above-prepared potassium hydroxide solution. The end point of the titration is when the indicator turns pink and the pink color is kept for 30 seconds.

(B) Blank Test

The same operation as the titration of the sample is performed on the toluene/ethanol (2:1) mixed solution not containing the amorphous or crystalline resin sample.

(3) The acid value is calculated using the titration result and the following equation:

$$\text{Acid value } A=[(C-B)\times f\times 5.61]/S$$

In this equation, A represents the acid value (mg KOH/g); B represents the volume (mL) of the potassium hydroxide solution added in the blank test; C represents the volume (mL) of the potassium hydroxide solution added in the titration of the sample; f represents the factor of the potassium hydroxide solution; and S represents the weight (g) of the sample.

Measurement of Weight-Average Particle Size (D4) of Toner Particles

The weight-average particle size (D4) of the toner particles is measured as below. This measurement is performed by a pore electric resistance method with a 100 μm-aperture tube, using a precise particle size distribution analyzer "Coulter Counter Multisizer 3" (registered trademark) manufactured by Beckman Coulter. For setting the measurement conditions and analyzing the measured data, a software program Multisizer 3 Version 3. 51 supplied from Beckman Coulter with the analyzer is used. The effective number of measurement channels is 25,000.

The electrolyte used for the measurement may be a solution prepared by dissolving highest-quality sodium chloride in ion exchanged water to a concentration of 1% by mass, such as ISOTON II (produced by Beckman Coulter).

Before the measurement and analysis, the software is set up as below.

The total count in the control mode is set to 50000 particles on the "standard measurement (SOMME) change screen" (in Japanese) of the software. Also, the number of measurements is set to 1, and Kd is set to a value obtained by use of "10.0 μm standard particles" (produced by Beckman Coulter). On pressing the threshold/noise level measurement button, the threshold and noise level are automatically set. The Current is set to 1600 μA; the Gain, to 2; and the electrolyte, to "ISOTON II". A check mark is placed at the statement of "flush of aperture tube after measurement" (in Japanese).

On the "Pulse-to-Particle Size Conversion Setting Screen" (in Japanese) of the software, the bin distance is set to logarithmic particle size; the particle size bin, to 256 particle size bins; and the particle size range, from 2 μm to 60 μm. Specifically, the measurement is performed according to the following procedure:

(1) A Multisizer-3-specific 250 mL glass round bottom beaker is charged with 200 mL of the electrolyte, and the electrolyte is stirred with a stirrer rod counterclockwise at 24 revolutions per second with the beaker set on a sample stand. The dirt and air bubbles in the aperture tube are removed by the "Aperture Flush" function of the software.

(2) A 100 mL glass flat bottom beaker is charged with 30 mL of the electrolyte. To the electrolyte is added 0.3 mL of dispersant "CONTAMINON N" dilute solution. CONTAMINON N is a 10% by mass aqueous solution of a pH 7 neutral detergent for precision measurement instruments containing a nonionic surfactant, an anionic surfactant, and an organic builder, produced by Wako Pure Chemical Industries, and the dilute solution of CONTAMINON N is prepared by diluting CONTAMINON N to three times its mass with ion exchanged water.

(3) There is prepared an ultrasonic dispersion system Tetra 150 (manufactured by Nikkaki Bios) having an electric power of 120 W and containing two oscillators of 50 kHz in oscillation frequency whose phases are shifted by 1800. To the water tank of the ultrasonic dispersion system is placed 3.3 L of ion exchanged water, and 2 mL of CONTAMINON N is added to the water tank.

(4) The beaker of the above (2) is set to a beaker securing hole of the ultrasonic dispersion system, and the ultrasonic dispersion system is started. Then, the level of the beaker is adjusted so that the resonance of the surface of the electrolyte in the beaker can be largest.

(5) In a state where ultrasonic waves are applied to the electrolyte in the beaker of (4), 10 mg of toner is added little by little to the electrolyte and dispersed. Such ultrasonic dispersion is further continued for 60 seconds. For the ultrasonic dispersion, the water temperature in the water tank is appropriately controlled in the range of from 10° C. to 40° C.

(6) The electrolyte of (5), in which the toner is dispersed, is dropped using a pipette into the round bottom beaker of the above (1) set on the sample stand to adjust the measurement concentration to 5%. Then, the measurement is performed until the number of measured particles comes to 50000.

(7) The measured data is subjected to analysis of the software to calculate the weight-average particle size (D4). Here, "Average size" on the "Analysis/Volume Statistic Value (Arithmetic Mean) screen" (in Japanese) in a state where graph/% by volume is set on the software represents the weight average particle size (D4).

EXAMPLES

The subject matter of the present disclosure will be further described with reference to the following Examples. It is however not limited to the disclosed Examples. The process for producing toners and toner particles will be described below. In the Examples and Comparative Examples, "part(s)" and "%" are on a mass basis unless otherwise specified.

Production Examples of Amorphous Resins

Production Example of Amorphous Resin 1

The following materials were added into an autoclave equipped with a pressure reducing device, a water separation device, a nitrogen gas-delivering device, a thermometer and a stirrer or an agitator:

Terephthalic acid: 15.0 parts
1,4-Cyclohexanedicarboxylic acid: 1.7 parts
2 mol Propylene oxide adduct of bisphenol A: 24.4 parts
Ethylene glycol: 1.8 parts
Potassium titanium oxalate (catalyst): 0.01 part relative to the total mass (100 parts) of the above constituents Subsequently, a reaction was performed to a desired molecular weight at normal pressure and 220° C. in a nitrogen atmosphere. After cooling, the product was pulverized to yield amorphous resin 1. Physical properties of amorphous resin 1 are shown in Table 2. Amorphous resin 1 did not exhibit a clear endothermic peak.

Production Examples of Amorphous Resins 2 to 12, 14 to 17, 21 and 22

Noncrystalline resins 2 to 12, 14 to 17, 21 and 22 were synthesized in the same manner as amorphous resin 1, except that the monomers were replaced with the compounds shown in Table 1. Amorphous resins 2 to 12, 14 to 17, 21 and 22 did not exhibit a clear endothermic peak. Physical properties of amorphous resins 2 to 12, 14 to 17, 21 and 22 are shown in Table 2.

Production Example of Amorphous Resin 13

Into an autoclave equipped with a pressure reducing device, a water separation device, a nitrogen gas-delivering device, a thermometer and a stirrer or an agitator, 300 parts of xylene (boiling point: 144° C.) was added. After the interior of the autoclave was fully purged with nitrogen gas while being stirred, the material was heated and refluxed. With the reflux continued, the mixture of the following materials was added into the autoclave.

Styrene: 96.7 parts
Methyl methacrylate: 2.5 parts
Methacrylic acid: 0.8 part
Di-tert-butyl peroxide (polymerization initiator): 2.0 parts Subsequently, polymerization was performed at a temperature of 140° C. for 5 hours. Then, the solvent, or xylene, was removed for 3 hours under reduced pressure, and the product was pulverized to yield amorphous resin 13. Amorphous resin 13 did not exhibit a clear endothermic peak. Physical properties of amorphous resin 13 are shown in Table 2.

Production Example of Amorphous Resin 18

Polymeric components (having a molecular weight of 20000 or more) were removed from amorphous resin 1 by the following preparative gas phase chromatography (GPC) to yield amorphous resin 18. Amorphous resin 18 did not exhibit a clear endothermic peak. Physical properties of amorphous resin 18 are shown in Table 2.

Configuration of Preparative GPC Apparatus
- LC-908 (manufactured by Japan Analytical Industry)
- JRS-86 repeat injector (manufactured by Japan Analytical Industry)
- JAR-2 auto sampler (manufactured by Japan Analytical Industry)
- FC-201 fraction collector (manufactured by Gilson) Column Configuration
- JAIGEL-1H to -5H (preparative columns, 20 mm in diameter by 600 mm in length)

Measuring Conditions
- Temperature: 40° C.
- Solvent: THF
- Flow rate: 5 mL/min
- Detector: RI The elution time corresponding to a molecular weight of 20000 was previously determined, and low-molecular weight components were separated out.

Production Example of Amorphous Resin 19

Low-molecular weight components (having a molecular weight of 2000 or less) were removed from amorphous resin 1 by preparative GPC to yield amorphous resin 19. Separation was performed in the same manner as in the case of Amorphous Resin 18. Amorphous resin 19 did not exhibit a clear endothermic peak. Physical properties of amorphous resin 19 are shown in Table 2.

Production Example of Amorphous Resin 20

Low-molecular weight components (having a molecular weight of 2000 or less) were removed from amorphous resin 14 by preparative GPC to yield amorphous resin 20. Separation was performed in the same manner as in the case of Amorphous Resin 18. Amorphous resin 20 did not exhibit a clear endothermic peak. Physical properties of amorphous resin 20 are shown in Table 2.

Production Example of Amorphous Resin 23

Into a reaction vessel equipped with a stirrer or an agitator, a thermometer, a nitrogen inlet, a dehydration tube and a pressure reducing device was added 100.0 pars of a mixture of monomer raw materials with a mole ratio shown in Table 3, and the mixture was heated to 120° C. while being stirred. Then, 0.50 part of tin di(2-ethylhexanoate) was added as an esterification catalyst, and the mixture was heated to 190° C. and polycondensated to a desired molecular weight. Thus amorphous resin 23 was produced. Amorphous resin 23 did not exhibit a clear endothermic peak.

Amorphous resin 23 had a weight average molecular weight of 19600, an acid value of 6.1 mg KOH/g, and a glass transition temperature of 78.2° C.

Production Examples of Amorphous Resins 24 to 38 and 41 to 43

Amorphous resins 24 to 38 and 41 to 43 were produced in the same manner as amorphous resin 23, except for the monomer raw materials, the amounts thereof and the temperature for polycondensation, according to Table 3. Amorphous resins 24 to 38 and 41 to 43 did not exhibit a clear endothermic peak. Physical properties of amorphous resins 24 to 38 and 41 to 43 are shown in Table 4.

Production Example of Amorphous Resin 39

Bisphenol A (modified with 2.2 mol of PO): 42.1 parts (27.3 mol %)
Bisphenol A (modified with 2.2 mol of EO): 12.8 parts (9.1 mol %)
Terephthalic acid: 22.9 parts (31.8 mol %)
Dodecenylsuccinic anhydride: 5.2 parts (4.5 mol %)
Fumaric acid: 4.6 parts (9.1 mol %)
Glycerin: 9.1 mol %
1,3-Adamantanedicarboxylic acid: 8.8 parts (9.1 mol %)

A reaction vessel equipped with a stirrer or an agitator, a thermometer, a nitrogen inlet, a dehydration tube and a pressure reducing device was charged with all the above monomer constituents except fumaric acid and glycerin, and 0.25 part of tin dioctanoate relative to the total mass (100 parts) of the above constituents. In a nitrogen flow, the mixture was subjected to reaction at 235° C. for 6 hours and then cooled to 200° C., and fumaric acid was added for reaction for 30 minutes. Then, glycerin was further added for reaction for 30 minutes. The sample was then heated up to 220° C. over a period of 4 hours and subjected to polymerization under a pressure of 10 kPa to yield amorphous resin 39. Amorphous resin 39 did not exhibit a clear endothermic peak. Physical properties of amorphous resin 39 are shown in Table 4.

Production Example of Amorphous Resin 40

Bisphenol A (modified with 2.2 mol of EO): 25.6 parts (40.0 mol %)
Bisphenol A (modified with 2.2 mol of PO): 42.0 parts (60.0 mol %)
Terephthalic acid: 15.4 parts (47.0 mol %)
Fumaric acid: 9.1 parts (40.0 mol %)
1,3-Adamantanedicarboxylic acid: 6.6 parts (15.0 mol %)
Trimellitic anhydride: 1.2 parts (3.0 mol %)

A reaction vessel equipped with a stirrer or an agitator, a thermometer, a nitrogen inlet, a dehydration tube and a pressure reducing device was charged with all the above monomer constituents except fumaric acid and trimellitic anhydride, and 0.25 part of tin dioctanoate relative to the total mass (100 parts) of the above monomer constituents. In a nitrogen flow, the mixture was subjected to reaction at 235° C. for 6 hours and then cooled to 200° C., and fumaric acid and trimellitic anhydride were added for reaction for 1 hour. The sample was then heated up to 220° C. over a period of 4 hours and polymerized to a weight average molecular weight of 34000 under a pressure of 10 kPa. Thus amorphous resin 40 was produced. Amorphous resin 40 did not exhibit a clear endothermic peak. Physical properties of amorphous resin 40 are shown in Table 4.

Production Example of Amorphous Resin 44

Bisphenol A (modified with 2.2 mol of EO): 25.6 parts (40.0 mol %)
Bisphenol A (modified with 2.2 mol of PO): 42.0 parts (60.0 mol %)
Terephthalic acid: 15.4 parts (47.0 mol %)
Fumaric acid: 9.1 parts (40.0 mol %)
1,3-Adamantanedicarboxylic acid: 6.6 parts (15.0 mol %)
Trimellitic anhydride: 1.2 parts (3.0 mol %)

A reaction vessel equipped with a stirrer, a thermometer, a nitrogen inlet, a dehydration tube and a pressure reducing device was charged with all the above monomer constituents except fumaric acid and trimellitic anhydride, and 0.25 part of tin dioctanoate relative to the total mass (100 parts) of the above monomer constituents. In a nitrogen flow, the mixture was subjected to reaction at 235° C. for 6 hours and then cooled to 200° C., and fumaric acid and trimellitic anhydride were added for reaction for 1 hour. The sample was then heated up to 220° C. over a period of 4 hours and polymerized to a weight average molecular weight of 40000 under a pressure of 10 kPa. Thus amorphous resin 44 was produced. Amorphous resin 44 did not exhibit a clear endothermic peak. Physical properties of amorphous resin 44 are shown in Table 4.

Production Example of Amorphous Resin 45

Bisphenol A (modified with 2.2 mol of PO): 42.8 parts (27.3 mol %)
Bisphenol A (modified with 2.2 mol of EO): 13.0 parts (9.1 mol %)
Terephthalic acid: 23.3 parts (31.8 mol %)
Dodecenylsuccinic anhydride: 5.3 parts (4.5 mol %)
Fumaric acid: 4.7 parts (9.1 mol %)
Glycerin: 3.7 parts (9.1 mol %)
1,3-Adamantane-1-carboxylic acid: 7.2 parts (9.1 mol %)

A reaction vessel equipped with a stirrer, a thermometer, a nitrogen inlet, a dehydration tube and a pressure reducing device was charged with all the above monomer constituents except fumaric acid, glycerin and adamantane-1-carboxylic acid, and 0.25 part of tin dioctanoate relative to the total mass (100 parts) of the above constituents. In a nitrogen flow, the mixture was subjected to reaction at 235° C. for 6 hours and then cooled to 200° C., and fumaric acid was added for reaction for 30 minutes. Then, glycerin was further added for reaction for 30 minutes. Subsequently, adamantane-1-carboxylic acid was added for reaction for another 1 hour. The sample was then heated up to 220° C. over a period of 4 hours and subjected to polymerization under a pressure of 10 kPa to yield amorphous resin 45. Amorphous resin 45 did not exhibit a clear endothermic peak. Physical properties of amorphous resin 45 are shown in Table 4.

Production Example of Amorphous Resin 46

Hydrogenated bisphenol A (modified with 2 mol of PO): 6.6 parts (5.0 mol %)

1,4-Cyclohexanediol: 2.2 parts (5.0 mol %)

Bisphenol A (modified with 3 mol of PO): 30.0 parts (20.0 mol %)

Bisphenol A (modified with 3 mol of EO): 26.8 parts (20.0 mol %)

Dodecenylsuccinic acid: 7.9 parts (8.0 mol %)

1,3-Cyclohexanedicarboxylic acid: 6.4 parts (10.0 mol %)

1,3,5-Cyclohexanetricarboxylic acid: 1.6 parts (2.0 mol %)

Isophthalic acid: 3.1 parts (5.0 mol %)

Terephthalic acid: 15.5 parts (25.0 mol %)

Into a reaction vessel equipped with a stirrer or an agitator, a thermometer, a nitrogen inlet, a dehydration tube and a pressure reducing device was added 100.0 pars of a mixture of the above monomer raw materials, and the mixture was heated to 120° C. while being stirred. Then, 0.50 part of tin di(2-ethylhexanoate) was added as an esterification catalyst, and the mixture was heated to 190° C. and polycondensated to a desired molecular weight. Thus amorphous resin 46 was produced. Amorphous resin 46 did not exhibit a clear endothermic peak. Physical properties of amorphous resin 46 are shown in Table 4.

Preparation Example of Amorphous Resin Dispersion Liquid 1

A 3 L reaction vessel BJ-30N (manufactured by Tokyo Rikakikai) equipped with a condenser, a thermometer, a water dripping device and an anchor blade was kept at 40° C. in a water circulating thermostatic bath. A mixed solvent of 160 parts of ethyl acetate and 100 parts of isopropyl alcohol was added into the reaction vessel. Then, 300 parts of amorphous resin 39 was added to the mixed solvent and dissolved in the solvent by stirring at 150 rpm with Three-One Motor to form an oil phase. Into the oil phase being stirred was dropped 14 parts of 10 mass % ammonia solution over a period of 5 minutes. After mixing for 10 minutes, 900 parts of ion exchanged water was dropped at a rate of 7 parts per minute for phase inversion, and thus an emulsified liquid was prepared.

Immediately, 800 parts of the resulting emulsified liquid and 700 parts of ion exchanged water were placed into a 2 L recovery flask. The recovery flask was attached to an evaporator (manufactured by Tokyo Rikakikai) equipped with a vacuum control unit, with a trap ball therebetween. The recovery flask was heated in a 60° C. water bath while being rotated, and depressurized to 7 kPa with care for sudden boiling to remove the solvent. When 1,100 parts of solvent had been recovered, the recovery flask was returned to normal pressure and cooled with cold water to yield a dispersion liquid. There was no solvent odor from the resulting dispersion liquid. The resin particles in the dispersion liquid had a median diameter of 130 nm on a volume basis. Then, ion exchanged water was added so as to obtain a solids content of 20% by mass, and thus amorphous resin dispersion liquid 1 was prepared.

Preparation Example of Amorphous Resin Dispersion Liquid 2

Amorphous polyester resin dispersion liquid 2 was prepared in the same manner as amorphous resin dispersion liquid 1 except that amorphous resin 39 was replaced with amorphous resin 40.

Preparation Example of Amorphous Resin Dispersion Liquid 3

Amorphous resin dispersion liquid 3 was prepared in the same manner as amorphous resin dispersion liquid 1 except that amorphous resin 39 was replaced with amorphous resin 41.

Preparation Example of Amorphous Resin Dispersion Liquid 4

Amorphous resin dispersion liquid 4 was prepared in the same manner as amorphous resin dispersion liquid 1 except that amorphous resin 39 was replaced with amorphous resin 44.

Preparation Example of Amorphous Resin Dispersion Liquid 5

Amorphous resin dispersion liquid 5 was prepared in the same manner as amorphous resin dispersion liquid 1 except that amorphous resin 39 was replaced with amorphous resin 45.

Preparation Example of Coloring Agent Dispersion Liquid 1

C.I. Pigment Red 122 (CHROMOFINE Magenta 6886 (product name), produced by Dainichiseika Color & Chemicals): 100 parts Polyoxyethylene nonylphenol ether (Neogen R (anionic surfactant), produced by Dai-ichi Kogyo Seiyaku): 15 parts Ion exchanged water: 900 parts These materials were mixed, and the coloring agent was dispersed in the mixture for about 1 hour with a high-pressure impact disperser Ultimizer HJP 30006 (manufactured by Sugino Machine) to yield a coloring agent dispersion liquid. The coloring agent in the dispersion liquid had a median diameter of 130 nm on a volume basis and a content of 10% by mass.

Preparation Examples of Releasing Agent Dispersion Liquid 1

Fischer-Tropsch wax FNP 0090 (product name, produced by Nippon Seiro): 270 parts Anionic surfactant Neogen RK (product name, produced by Dai-ichi Kogyo Seiyaku): 13.5 parts Ion exchanged water: 21.6 parts These materials were mixed, and the releasing agent was dissolved at an internal liquid temperature of 120° C. with a pressure discharge homogenizer (Gaulin homogenizer, manufactured by Gaulin). Then, the mixture was subjected to dispersion at a pressure of 5 MPa for 120 minutes and subsequently at 40 MPa for 360 minutes. The resulting dispersion was cooled to yield releasing agent dispersion liquid 1. The particles in this releasing agent dispersion liquid had a median diameter of 225 nm on a volume basis. Then, ion exchanged water was added so as to obtain a solids content of 10.0% by mass.

Preparation Example of Releasing Agent Dispersion Liquid 2

Releasing agent dispersion liquid 2 was prepared in the same manner as releasing agent dispersion liquid 1 except that the Fischer-Tropsch wax used as a release agent was replaced with behenyl behenate.

Preparation Example of Releasing Agent Dispersion Liquid 3

Releasing agent dispersion liquid 3 was prepared in the same manner as releasing agent dispersion liquid 1 except that the Fischer-Tropsch wax used as a release agent was replaced with pentaerythritol tetrabehenate.

Production Examples of Crystalline Resins

Production Example of Crystalline Resin 1

The following materials were added into an autoclave equipped with a pressure reducing device, a water separation device, a nitrogen gas-delivering device, a thermometer and a stirrer or an agitator:

Sebacic acid: 20.2 parts 1,12-Dodecanediol: 40.4 parts

Potassium titanium oxalate (catalyst): 0.02 part

Subsequently, a reaction was performed to a desired molecular weight at normal pressure and 220° C. in a nitrogen atmosphere. After cooling to 170° C., 5.0 parts of stearyl alcohol was added for reaction at 170° C. for 1.0 hour. After cooling, the reaction product was pulverized to yield crystalline resin 1. The resulting crystalline resin 1 was subjected to measurement for changes in specific heat with a differential scanning calorimeter according to the above-described measurement for the melting point Tm of the crystalline resin. As a result, crystalline resin 1 exhibited a clear endothermic peak at 85° C. in a curve of reversible specific heat changes. This suggests that crystalline resin 1 was a crystalline resin. Physical properties of crystalline resin 1 are shown in Table 5.

Production Examples of Crystalline Resins 2 to 5

Crystalline resin 2 to 5 were produced by a reaction performed up to a desired molecular weight in the same manner as crystalline resin 1, except that stearyl alcohol was not added. The resulting crystalline resins 2 to 5 were subjected to measurement for changes in specific heat with a differential scanning calorimeter according to the above-described measurement for the melting point Tm of the crystalline resin. As a result, the crystalline resins exhibited a clear endothermic peak in a curve of reversible specific heat changes. This suggests that crystalline resins 2 to 5 were crystalline resins. Physical properties of crystalline resins 2 to 5 are shown in Table 5.

Production Example of Crystalline Resin 6

The following materials were added into an autoclave equipped with a pressure reducing device, a water separation device, a nitrogen gas-delivering device, a thermometer and a stirrer or an agitator:

Sebacic acid: 20.2 parts 1,6-Hexanediol: 11.8 parts

Potassium titanium oxalate (catalyst): 0.02 part

Subsequently, a reaction was performed to a desired molecular weight at normal pressure and 220° C. in a nitrogen atmosphere. After cooling, the reaction product was pulverized to yield crystalline resin 6. The resulting crystalline resin 6 was subjected to measurement for changes in specific heat with a differential scanning calorimeter according to the above-described measurement for the melting point Tm of the crystalline resin. As a result, the crystalline resin exhibited a clear endothermic peak in a curve of reversible specific heat changes. This suggests that crystalline resin 6 was a crystalline resin. Physical properties of crystalline resin 6 are shown in Table 5.

TABLE 1

| Amorphous resin | TPA | CHDA | SA | 5-Norbornene-2,3-dicarboxylic anhydride | 2 mol PO adduct of BPA | EG | CHDM | CHDO | Isosorbide | 4,4'-Bicyclohexano |
|---|---|---|---|---|---|---|---|---|---|---|
| 1 | 15.0 | 1.7 | 0.0 | 0.0 | 24.4 | 1.9 | 0.0 | 0.0 | 0.0 | 0.0 |
| 2 | 16.6 | 0.0 | 0.0 | 0.0 | 20.9 | 1.9 | 0.0 | 1.2 | 0.0 | 0.0 |
| 3 | 16.6 | 0.0 | 0.0 | 0.0 | 20.9 | 1.9 | 1.4 | 0.0 | 0.0 | 0.0 |
| 4 | 15.8 | 0.9 | 0.0 | 0.0 | 22.7 | 2.2 | 0.0 | 0.0 | 0.0 | 0.0 |
| 5 | 15.8 | 0.9 | 0.0 | 0.0 | 26.1 | 1.6 | 0.0 | 0.0 | 0.0 | 0.0 |
| 6 | 15.8 | 0.9 | 0.0 | 0.0 | 24.4 | 1.9 | 0.0 | 0.0 | 0.0 | 0.0 |
| 7 | 15.8 | 0.9 | 0.0 | 0.0 | 20.9 | 2.5 | 0.0 | 0.0 | 0.0 | 0.0 |
| 8 | 16.3 | 0.3 | 0.0 | 0.0 | 24.4 | 1.9 | 0.0 | 0.0 | 0.0 | 0.0 |
| 9 | 12.5 | 4.3 | 0.0 | 0.0 | 24.4 | 1.9 | 0.0 | 0.0 | 0.0 | 0.0 |
| 10 | 10.0 | 6.9 | 0.0 | 0.0 | 10.5 | 1.9 | 5.8 | 0.0 | 0.0 | 0.0 |
| 11 | 7.5 | 9.5 | 0.0 | 0.0 | 5.2 | 1.9 | 7.9 | 0.0 | 0.0 | 0.0 |
| 12 | 16.6 | 0.0 | 0.0 | 0.0 | 22.7 | 1.9 | 0.0 | 0.0 | 0.7 | 0.0 |
| 14 | 16.6 | 0.0 | 0.0 | 0.0 | 26.1 | 1.6 | 0.0 | 0.0 | 0.0 | 0.0 |
| 15 | 16.6 | 0.0 | 0.0 | 0.0 | 19.2 | 2.8 | 0.0 | 0.0 | 0.0 | 0.0 |
| 16 | 16.6 | 0.0 | 0.0 | 0.0 | 34.8 | 0.0 | 0.0 | 0.0 | 0.0 | 0.0 |
| 17 | 13.3 | 0.0 | 4.0 | 0.0 | 24.4 | 1.9 | 0.0 | 0.0 | 0.0 | 0.0 |
| 21 | 15.0 | 0.0 | 0.0 | 1.6 | 24.4 | 1.9 | 0.0 | 0.0 | 0.0 | 0.0 |
| 22 | 16.6 | 0.0 | 0.0 | 0.0 | 20.9 | 1.9 | 0.0 | 0.0 | 0.0 | 2.0 |

In Table 1, the numerical values are represented on a mass part basis and the abbreviations represent the following materials: TPA represents terephthalic acid; CHDA, 1,4-cyclohexanedicarboxylic acid; SA, sebacic acid; 2 mol PO adduct of BPA, 2 mol propylene oxide adduct of bisphenol A; EG, ethylene glycol; CHDM, 1,4-cyclohexanedimethanol; and CHDO, 1,4-cyclohexanediol.

TABLE 2

| | Tg (° C.) | Mw | Mn | Acid value (mg KOH/g) |
|---|---|---|---|---|
| Amorphous resin 1 | 68 | 15000 | 4200 | 5.1 |
| Amorphous resin 2 | 69 | 14200 | 3800 | 5.5 |
| Amorphous resin 3 | 69 | 15300 | 4400 | 5.0 |

TABLE 2-continued

| | Tg (° C.) | Mw | Mn | Acid value (mg KOH/g) |
|---|---|---|---|---|
| Amorphous resin 4 | 67 | 16700 | 4700 | 4.6 |
| Amorphous resin 5 | 69 | 14400 | 3700 | 5.4 |
| Amorphous resin 6 | 68 | 15200 | 4300 | 5.0 |
| Amorphous resin 7 | 66 | 17200 | 5100 | 4.4 |
| Amorphous resin 8 | 69 | 14800 | 4000 | 5.1 |
| Amorphous resin 9 | 67 | 15600 | 4500 | 4.9 |
| Amorphous resin 10 | 66 | 15500 | 4200 | 4.9 |
| Amorphous resin 11 | 64 | 14800 | 4000 | 5.2 |
| Amorphous resin 12 | 72 | 14500 | 3600 | 5.3 |
| Amorphous resin 13 | 89 | 16000 | 6200 | 5.1 |
| Amorphous resin 14 | 67 | 15300 | 4600 | 5.1 |
| Amorphous resin 15 | 65 | 16500 | 4800 | 4.5 |
| Amorphous resin 16 | 70 | 15200 | 4500 | 5.1 |
| Amorphous resin 17 | 64 | 16600 | 4800 | 4.7 |
| Amorphous resin 18 | 66 | 14200 | 4200 | 5.5 |
| Amorphous resin 19 | 70 | 16100 | 5200 | 4.8 |
| Amorphous resin 20 | 69 | 16400 | 5400 | 4.7 |
| Amorphous resin 21 | 70 | 15200 | 4600 | 5.2 |
| Amorphous resin 22 | 68 | 15400 | 4500 | 5.1 |

TABLE 4-continued

| | Mw | Acid value mg KOH/g | Tg ° C. |
|---|---|---|---|
| Amorphous resin 25 | 20300 | 14.6 | 75.6 |
| Amorphous resin 26 | 19400 | 3.6 | 74.4 |
| Amorphous resin 27 | 20800 | 1.8 | 77.3 |
| Amorphous resin 28 | 33500 | 4.2 | 81.2 |
| Amorphous resin 29 | 27800 | 5.1 | 79.5 |
| Amorphous resin 30 | 24300 | 5.3 | 78.8 |
| Amorphous resin 31 | 12400 | 8.0 | 75.4 |
| Amorphous resin 32 | 6200 | 9.8 | 73.0 |
| Amorphous resin 33 | 3800 | 11.3 | 69.5 |
| Amorphous resin 34 | 18400 | 6.7 | 84.2 |
| Amorphous resin 35 | 18800 | 6.3 | 82.5 |
| Amorphous resin 36 | 19100 | 6.0 | 81.0 |
| Amorphous resin 37 | 21200 | 5.7 | 75.3 |
| Amorphous resin 38 | 22000 | 5.5 | 73.7 |
| Amorphous resin 39 | 22000 | 3.1 | 70.2 |
| Amorphous resin 40 | 34000 | 4.1 | 54.2 |
| Amorphous resin 41 | 19600 | 6.1 | 72.0 |
| Amorphous resin 42 | 36300 | 3.8 | 81.8 |
| Amorphous resin 43 | 2700 | 12.8 | 67.9 |
| Amorphous resin 44 | 40000 | 4.8 | 55.0 |

TABLE 3

| Amorphous resin | Alcohol monomer: Adamantane structure containing monomer | Amount | EG | 2 mol PO-modified BPA | Acid monomer: Adamantane structure containing monomer | Amount | TMA | TPA | Adamantane unit percentage |
|---|---|---|---|---|---|---|---|---|---|
| 23 | 1,3-Adamantanediol | 3.4 | 3.8 | 42.8 | — | | 3.8 | 42.8 | 5.0% |
| 24 | 1,3-Adamantane-dimethanol | 4.0 | 3.8 | 42.3 | — | | 3.8 | 42.3 | 5.0% |
| 25 | — | | 3.5 | 46.5 | 1,3-Adamantane-dicarboxylic acid | 4.3 | 3.5 | 46.5 | 5.0% |
| 26 | — | | 3.5 | 46.5 | 1,3-Adamantane-diacetic acid | 4.8 | 3.5 | 46.5 | 5.0% |
| 27 | 3-(Hydroxymethyl)-1-adamantanol | 3.7 | 3.8 | 42.5 | — | | 3.8 | 42.5 | 5.0% |
| 28 | 1,3-Adamantanediol | 3.4 | 3.8 | 42.8 | — | | 3.8 | 42.8 | 5.0% |
| 29 | 1,3-Adamantanediol | 3.4 | 3.8 | 42.8 | — | | 3.8 | 42.8 | 5.0% |
| 30 | 1,3-Adamantanediol | 3.4 | 3.8 | 42.8 | — | | 3.8 | 42.8 | 5.0% |
| 31 | 1,3-Adamantanediol | 3.4 | 3.8 | 42.8 | — | | 3.8 | 42.8 | 5.0% |
| 32 | 1,3-Adamantanediol | 3.4 | 3.8 | 42.8 | — | | 3.8 | 42.8 | 5.0% |
| 33 | 1,3-Adamantanediol | 3.4 | 3.8 | 42.8 | — | | 3.8 | 42.8 | 5.0% |
| 34 | 1,3-Adamantane-dimethanol | 30.2 | 5.2 | 14.6 | 1,3-Adamantane-diacetic acid | 38.8 | 5.2 | 14.6 | 55.0% |
| 35 | 1,3-Adamantane-dimethanol | 30.2 | 5.2 | 14.6 | 1,3-Adamantane-diacetic acid | 24.7 | 5.2 | 14.6 | 45.0% |
| 36 | 1,3-Adamantane-dimethanol | 30.2 | 5.2 | 14.6 | — | | 5.2 | 14.6 | 27.5% |
| 37 | 1,3-Adamantane-dimethanol | 1.1 | 3.6 | 45.3 | — | | 3.6 | 45.3 | 1.5% |
| 38 | 1,3-Adamantane-dimethanol | 0.6 | 3.6 | 45.8 | — | | 3.6 | 45.8 | 0.8% |
| 41 | — | | 3.5 | 46.5 | — | | 3.5 | 46.5 | 0.0% |
| 42 | 1,3-Adamantanediol | 3.4 | 3.8 | 42.8 | — | | 3.8 | 42.8 | 5.0% |
| 43 | 1,3-Adamantanediol | 3.4 | 3.8 | 42.8 | — | | 3.8 | 42.8 | 5.0% |

In Table 3, the numerical values are represented on a mass part basis and the abbreviations represent as follows: TPA represents terephthalic acid; TMA, trimellitic acid; 2 mol PO-modified BPA, bisphenol A modified with 2 mol of propylene oxide; and EG, ethylene glycol.

TABLE 4

| | Mw | Acid value mg KOH/g | Tg ° C. |
|---|---|---|---|
| Amorphous resin 23 | 19600 | 6.1 | 78.2 |
| Amorphous resin 24 | 19800 | 16.2 | 75.8 |

TABLE 4-continued

| | Mw | Acid value mg KOH/g | Tg ° C. |
|---|---|---|---|
| Amorphous resin 45 | 20000 | 7.2 | 70.4 |
| Amorphous resin 46 | 22000 | 4.0 | 70.0 |

TABLE 5

| Crystalline resin | Melting point (° C.) | Mw | Mn | Acid value (mg KOH/g) |
|---|---|---|---|---|
| 1 | 85 | 18500 | 6200 | 1.4 |
| 2 | 84 | 9800 | 3500 | 6.2 |
| 3 | 83 | 6200 | 1900 | 9.8 |
| 4 | 86 | 35700 | 11400 | 1.7 |
| 5 | 87 | 52000 | 15200 | 1.1 |
| 6 | 70 | 18900 | 7200 | 7.2 |

Production Examples of Toners

Production Example of Toner 1

Styrene: 60.0 parts

C.I. Pigment Red 122 (Chromofine Magenta 6886 (product name), produced by Dainichiseika Color & Chemicals): 8.0 parts Charge control agent BONTRON E-84 (produced by Orient Chemical Industries): 1.0 part These materials were added into an attritor dispersion machine (manufactured by Nippon Coke & Engineering) and then dispersed in each other at 220 rpm for 5 hours with zirconia grains of 1.7 mm in diameter to yield a pigment dispersion liquid. To the resulting pigment dispersion liquid were added the following materials:

Styrene: 18.0 parts n-Butyl acrylate: 22.0 parts

Amorphous resin 1: 5.0 parts

Crystalline resin 1: 10.0 parts

Paraffin wax HNP-9 (product name, produced by Nippon Seiro): 5.0 parts

These materials were kept at 65° C. and uniformly dissolved or dispersed in each other at 500 rpm with TK homomixer (manufactured by Primix). In the resulting mixture was dissolved 4.4 parts of t-butylperoxy-2-ethyl hexanoate PERBUTYL O (product name, produced by NOF Corporation) as a polymerization initiator. Thus a polymerizable monomer composition was prepared.

Meanwhile, 850 parts of 0.1 mol/L $Na_3PO_4$ aqueous solution and 8.0 parts of 10 mass % hydrochloric acid aqueous solution were added to a container equipped with a high-speed agitator CLEARMIX (manufactured by M Technique) set to a rotational speed of 15000 rpm and were then heated to 60° C. Into this container was added 68 parts of 1.0 mol/L $CaCl_2$ aqueous solution to prepare an aqueous medium containing very small particles of a poorly water-soluble dispersant $Ca_3(PO_4)_2$. Five minutes after the above operation of adding the polymerization initiator to the polymerizable monomer composition, the polymerizable monomer composition of 60° C. was added into the aqueous medium heated to 600° C. The mixture was subjected to granulation with a high-speed agitator CLEARMIX at 15000 rpm for 15 minutes. Then, the high-speed agitator was replaced with a propeller stirring blade, and the sample was subjected to a reaction at 60° C. for 5 hours while being refluxed, and then at a liquid temperature of 80° C. for another 5 hours. After the completion of polymerization, the reaction liquid was cooled to about 20° C., and the pH of the aqueous medium was adjusted to 3.0 or less with dilute hydrochloric acid to dissolve the poorly water-soluble dispersant. Furthermore, the reaction product was washed and dried to yield toner particles.

Then, 2.0 parts of silica fine particles (number average particle size of primary particles: 10 nm, BET specific surface area: 170 $m^2/g$) was added as an external additive to 100.0 parts of the resulting toner particles, and the particles were mixed with a HENSCHEL MIXER (manufactured by Nippon Coke & Engineering) at 3000 rpm for 15 minutes to yield Toner 1. The physical properties of Toner 1 are shown in Table 7. The silica fine particles had been hydrophobized with dimethyl silicone oil (20 mass %) and would be triboelectrically charged to the same polarity (negative) as toner particles. The adsorption rate A3 to the pigment in this process was the adsorption rate to the pigment of a resin produced by a reaction performed in the same manner as the foregoing production example except that styrene and n-butyl acrylate were not added. C.I. Pigment Red 122 used in Toner 1 is a magenta pigment having a quinacridone skeleton.

Production Examples of Toners 2 to 20 and 23 to 30

Toners 2 to 20 and 23 to 30 were produced in the same manner as Toner 1, except that the combination of the materials was changed according to Table 6. The physical properties of Toners 2 to 20 and 23 to 30 are shown in Table 7.

Production Example of Toner 21

A dissolution suspension toner was produced in the following process.

Preparation Example of Wax Dispersion Liquid

Into 100.0 parts of methanol was added 100.0 parts of a paraffin wax HNP-9 (product name, produced by Nippon Seiro) pulverized to an average particle size of 20 μm, and thus the wax was washed at a rotational speed of 150 rpm for 10 minutes, followed by being separated out through a filter. After repeating this operation three times, the wax was separated out through a filter and dried.

Into an attritor (manufactured by Nippon Coke & Engineering) containing zirconia beads of 20 mm in diameter were added 100.0 parts of the resulting wax and 100.0 parts of ethyl acetate, and the materials were dispersed in each other at 150 rpm for 2 hours. The zirconia beads were removed to yield a wax dispersion liquid.

Preparation Example of Coloring Agent Dispersion Liquid

C.I. Pigment Red 122 (Chromofine Magenta 6886 (product name), produced by Dainichiseika Color & Chemicals): 20.0 parts Ethyl acetate: 80.0 parts Charge control agent BONTRON E-84 (produced by Orient Chemical Industries): 2.5 parts These materials were added into an attritor (manufactured by Nippon Coke & Engineering) containing zirconia beads of 1.7 mm in diameter and dispersed in each other at a rotational speed of 200 rpm for 5 hours. The zirconia beads were removed to yield a coloring agent dispersion liquid.

Production Example of Toner

The following materials were uniformly mixed to prepare a toner composition:

Binder resin styrene-n-butyl acrylate copolymer: 100.0 parts
(styrene:n-butyl acrylate ratio=78:22, Mp=22000, Mw=35000, Mw/Mn=2.4, Tg=55° C.)
Amorphous resin 1: 5.0 parts
Crystalline resin 4: 10.0 parts
Wax dispersion liquid: 10.0 parts
Coloring agent dispersion liquid: 40.0 parts Meanwhile, 850 parts of 0.1 mol/L $Na_3PO_4$ aqueous solution and 8.0 parts of 10 mass % hydrochloric acid aqueous solution were added to a container equipped with a high-speed agitator CLEARMIX (manufactured by M Technique) set to a rotational speed of 15000 rpm and were then heated to 60° C. Into this container was added 68 parts of 1.0 mol/L $CaCl_2$ aqueous solution to prepare an aqueous medium containing very small particles of a poorly water-soluble dispersant $Ca_3(PO_4)_2$.

With the aqueous medium kept at a temperature of 30° C. and a rotational speed of 15000 rpm, the above-prepared toner composition was added to this aqueous medium and subjected to granulation for 2 minutes. Then, 500 parts of ion exchanged water was added. The high-speed agitator CLEARMIX was replaced with a propeller stirring blade set to a rotational speed of 150 rpm, and the container was evacuated to 52 kPa with the aqueous medium kept at a temperature of 30° C. to 35° C. so that ethyl acetate was removed to a residual content of 200 ppm.

Subsequently, the aqueous medium was heated to 80° C. and heat-treated at 80° C. for 30 minutes. Then, the aqueous medium was cooled to 25° C. at a rate of 0.15° C./min. With the internal temperature kept from 20.0° C. to 25.0° C., dilute hydrochloric acid was added to the aqueous medium to dissolve the poorly water-soluble dispersant. Furthermore, the reaction product was washed and dried to yield toner particles. An external additive was added to the resulting toner particles in the same manner as in the production example of Toner 1, and thus Toner 21 was produced. The physical properties of Toner 21 are shown in Table 7.

Production Example of Toner 22

A pulverization toner was produced in the following process.

Binder resin styrene-n-butyl acrylate copolymer: 100.0 parts
(styrene:n-butyl acrylate ratio=78:22, Mp=22000, Mw=35000, Mw/Mn=2.4, Tg=55° C.)
C.I. Pigment Red 122 (Chromofine Magenta 6886 (product name), produced by Dainichiseika Color & Chemicals): 8.0 parts
Charge control agent BONTRON E-84: 1.0 part
Paraffin wax HNP-9 (product name): 5.0 parts
Amorphous resin 1: 5.0 parts
Crystalline resin 5: 10.0 parts These materials were mixed with a HENSCHEL MIXER (manufactured by Nippon Coke & Engineering) and then kneaded with a twin screw kneader PCM-30 (manufactured by Ikegai). The kneaded product was cooled and roughly pulverized in a hammer mill (manufactured by Hosokawa Micron) and then further pulverized into a finely pulverized powder with a mechanical pulverizer T-250 (manufactured by Turbo Kogyo). The resulting powder was sized to yield toner particles with a multi-classification classifier EJ-L-3 (manufactured by Nittetsu Mining) using the Coanda effect. An external additive was added to the resulting toner particles in the same manner as in the production example of Toner 1, and thus Toner 22 was produced. The physical properties of Toner 22 are shown in Table 7.

TABLE 6

| | Amorphous resin | Crystalline resin | Pigment |
|---|---|---|---|
| Toner 1 | Amorphous resin 1 | Crystalline resin 1 | C.I. Pigment Red 122 |
| Toner 2 | Amorphous resin 2 | Crystalline resin 1 | C.I. Pigment Red 122 |
| Toner 3 | Amorphous resin 3 | Crystalline resin 1 | C.I. Pigment Red 122 |
| Toner 4 | Amorphous resin 4 | Crystalline resin 2 | C.I. Pigment Red 122 |
| Toner 5 | Amorphous resin 5 | Crystalline resin 2 | C.I. Pigment Red 122 |
| Toner 6 | Amorphous resin 6 | Crystalline resin 1 | C.I. Pigment Red 122 |
| Toner 7 | Amorphous resin 7 | Crystalline resin 3 | C.I. Pigment Red 122 |
| Toner 8 | Amorphous resin 5 | Crystalline resin 3 | C.I. Pigment Red 122 |
| Toner 9 | Amorphous resin 18 | Crystalline resin 1 | C.I. Pigment Red 122 |
| Toner 10 | Amorphous resin 19 | Crystalline resin 1 | C.I. Pigment Red 122 |
| Toner 11 | Amorphous resin 8 | Crystalline resin 1 | C.I. Pigment Red 122 |
| Toner 12 | Amorphous resin 9 | Crystalline resin 1 | C.I. Pigment Red 122 |
| Toner 13 | Amorphous resin 10 | Crystalline resin 1 | C.I. Pigment Red 122 |
| Toner 14 | Amorphous resin 11 | Crystalline resin 1 | Carbon Black 1 (*) |
| Toner 15 | Amorphous resin 12 | Crystalline resin 1 | C.I. Pigment Red 122 |
| Toner 16 | Amorphous resin 1 | Crystalline resin 2 | C.I. Pigment Red 122 |
| Toner 17 | Amorphous resin 1 | Crystalline resin 4 | C.I. Pigment Red 122 |
| Toner 18 | Amorphous resin 1 | Crystalline resin 5 | C.I. Pigment Red 122 |
| Toner 19 | Amorphous resin 1 | Crystalline resin 1 | C.I. Pigment Red 122 |
| Toner 20 | Amorphous resin 13 | Crystalline resin 1 | C.I. Pigment Red 122 |
| Toner 21 | Amorphous resin 1 | Crystalline resin 4 | C.I. Pigment Red 122 |
| Toner 22 | Amorphous resin 1 | Crystalline resin 5 | C.I. Pigment Red 122 |
| Toner 23 | Amorphous resin 20 | Crystalline resin 1 | C.I. Pigment Red 122 |
| Toner 24 | Amorphous resin 14 | Crystalline resin 1 | C.I. Pigment Red 122 |
| Toner 25 | Amorphous resin 15 | Crystalline resin 1 | C.I. Pigment Red 122 |
| Toner 26 | Amorphous resin 16 | Crystalline resin 1 | C.I. Pigment Red 122 |
| Toner 27 | Amorphous resin 15 | Crystalline resin 1 | C.I. Pigment Red 122 |
| Toner 28 | Amorphous resin 18 | Crystalline resin 6 | Carbon Black 1 (*) |
| Toner 29 | Amorphous resin 1 | Crystalline resin 4 | Carbon Black 2 (*) |
| Toner 30 | Amorphous resin 17 | Crystalline resin 1 | C.I. Pigment Red 122 |
| Toner 31 | Amorphous resin 21 | Crystalline resin 1 | C.I. Pigment Red 122 |
| Toner 32 | Amorphous resin 22 | Crystalline resin 1 | C.I. Pigment Red 122 |
| Toner 33 | Amorphous resin 23 | Crystalline resin 1 | C.I. Pigment Red 122 |
| Toner 34 | Amorphous resin 28 | Crystalline resin 1 | C.I. Pigment Red 122 |
| Toner 35 | Amorphous resin 32 | Crystalline resin 1 | C.I. Pigment Red 122 |
| Toner 36 | Amorphous resin 44 | Crystalline resin 1 | C.I. Pigment Red 122 |

In Table 6, the carbon blacks are as follows: Carbon black 1(*) represents Printex 35 (carbon black produced by Degussa); and Carbon black 2(*) represents Special Black 350 (carbon black produced by Degussa).

TABLE 7

| | A1 | A2 | A2 − A1 | Degree of compatibility | Amount of alicyclic structure units | A3 | D4 (μm) | Production method |
|---|---|---|---|---|---|---|---|---|
| Toner 1 | 10% | 40% | 30% | 50% | 5.0% | 5% | 6.2 | Suspension polymerization |
| Toner 2 | 10% | 40% | 30% | 50% | 5.0% | 5% | 6.1 | Suspension polymerization |
| Toner 3 | 10% | 40% | 30% | 50% | 5.0% | 5% | 6.3 | Suspension polymerization |
| Toner 4 | 10% | 50% | 40% | 55% | 2.5% | 5% | 6.2 | Suspension polymerization |
| Toner 5 | 10% | 40% | 30% | 60% | 2.5% | 5% | 6.4 | Suspension polymerization |
| Toner 6 | 10% | 42% | 32% | 53% | 2.5% | 5% | 6.2 | Suspension polymerization |
| Toner 7 | 10% | 55% | 45% | 55% | 2.5% | 5% | 6.2 | Suspension polymerization |
| Toner 8 | 10% | 40% | 30% | 65% | 2.5% | 5% | 6.1 | Suspension polymerization |
| Toner 9 | 10% | 25% | 15% | 60% | 5.0% | 5% | 6.3 | Suspension polymerization |
| Toner 10 | 10% | 45% | 35% | 30% | 5.0% | 5% | 6.4 | Suspension polymerization |
| Toner 11 | 10% | 45% | 35% | 55% | 1.0% | 5% | 6.5 | Suspension polymerization |
| Toner 12 | 10% | 43% | 33% | 48% | 12.5% | 5% | 6.2 | Suspension polymerization |
| Toner 13 | 10% | 50% | 40% | 48% | 40.0% | 5% | 6.2 | Suspension polymerization |
| Toner 14 | 10% | 58% | 48% | 60% | 55.0% | 5% | 6.2 | Suspension polymerization |
| Toner 15 | 10% | 50% | 40% | 60% | 2.5% | 5% | 6.3 | Suspension polymerization |
| Toner 16 | 10% | 40% | 30% | 60% | 5.0% | 5% | 6.4 | Suspension polymerization |
| Toner 17 | 15% | 40% | 25% | 50% | 5.0% | 5% | 6.4 | Suspension polymerization |
| Toner 18 | 30% | 40% | 10% | 40% | 5.0% | 5% | 6.3 | Suspension polymerization |
| Toner 19 | 10% | 40% | 30% | 50% | 5.0% | 5% | 6.3 | Suspension polymerization |
| Toner 20 | 10% | 25% | 15% | 65% | 0.0% | 5% | 7.1 | Suspension polymerization |
| Toner 21 | 15% | 40% | 25% | 50% | 5.0% | 5% | 6.8 | dissolution suspension |
| Toner 22 | 30% | 40% | 10% | 40% | 5.0% | 5% | 6.3 | Pulverization |
| Toner 23 | 10% | 55% | 45% | 65% | 0.0% | 5% | 6.3 | Suspension polymerization |
| Toner 24 | 10% | 55% | 45% | 75% | 0.0% | 5% | 6.2 | Suspension polymerization |
| Toner 25 | 10% | 70% | 60% | 60% | 0.0% | 5% | 6.4 | Suspension polymerization |
| Toner 26 | 10% | 40% | 30% | 100% | 0.0% | 5% | 6.5 | Suspension polymerization |
| Toner 27 | 10% | 70% | 60% | 60% | 0.0% | 5% | 6.7 | Suspension polymerization |
| Toner 28 | 20% | 25% | 5% | 90% | 5.0% | 5% | 6.3 | Suspension polymerization |
| Toner 29 | 0% | 25% | 25% | 50% | 5.0% | 0% | 5.4 | Suspension polymerization |
| Toner 30 | 10% | 15% | 5% | 100% | 0.0% | 5% | 6.2 | Suspension polymerization |
| Toner 31 | 10% | 40% | 30% | 50% | 5.0% | 5% | 6.2 | Suspension polymerization |
| Toner 32 | 10% | 38% | 28% | 50% | 5.0% | 5% | 6.1 | Suspension polymerization |
| Toner 33 | 10% | 35% | 25% | 50% | 5.0% | 5% | 6.2 | Suspension polymerization |
| Toner 34 | 10% | 55% | 45% | 48% | 5.0% | 5% | 6.8 | Suspension polymerization |
| Toner 35 | 10% | 35% | 25% | 60% | 5.0% | 5% | 5.9 | Suspension polymerization |
| Toner 36 | 10% | 62% | 52% | 45% | 5.0% | 5% | 7.2 | Suspension polymerization |

In Table 7, A1, A2 and A3 represent adsorption rates to the pigment of the crystalline resin, the amorphous resin and the binder resin, respectively. "Amount of alicyclic structure unit" represents the ratio of the amount by mole of the unit derived from an alcohol having an alicyclic structure or a carboxylic acid having an alicyclic structure to the amount by mole of all the units.

Examples 1 to 28, Comparative Examples 1 to 8

Toners 1 to 36 were evaluated as shown in Table 8. Table 8 also show the results of evaluations.

Each toner was evaluated and rated as below. For the evaluations, the combination of a modified Canon laser printer LBP-7700C and a Canon process cartridge Toner Cartridge 323 (magenta) was used as an image forming apparatus. The original toner product was removed from the cartridge. After being cleaned by blowing air, the cartridge was charged with 150 g of toner of any one of the Examples and Comparative Examples. For the yellow, cyan and black stations, the original toner product was removed from each of the yellow, cyan and black cartridges, and the mechanism for detecting the amount of remaining toner was turned invalid in each cartridge.

1. Evaluation of Coloring Power 1-1 Image Density

The magenta process cartridge charged with a toner was allowed to stand in an environment of room temperature (23° C.) and normal humidity (50% RH) (hereinafter referred to as N/N environment) for 48 hours. Using the image forming apparatus LBP-7700C modified so that the fuser was able to operate outside the apparatus, a pattern of 9 square images each measuring 10 mm by 10 mm and uniformly arranged over the entire area of a transfer paper was output as an unfixed image pattern. The amount of toner to be deposited on the transfer paper was set to 0.40 mg/cm$^2$. The transfer paper used was plain paper (A4: 81.4 g/m$^2$) for Canon color laser printers. The fuser was removed from LBP-7700C, and an external fuser modified so as to operate outside the laser beam printer was used. The output image pattern was fixed at a temperature of 160° C. and a process speed of 240 mm/s.

The image density of the 10 mm×10 mm square images was measured as the relative image density to the image density 0.00 of a blank portion with Macbeth reflection densitometer RD 918 (manufactured by Macbeth) in accordance with the instruction manual supplied with the densitometer. The measured relative densities of the 9 square images were averaged to yield the image density of the sample. The obtained image density was rated according to the following criteria for evaluation of the coloring power:

A: The image density was 1.40 or more, and the coloring power was evaluated to be excellent.

B: The image density was in the range of 1.30 or more and less than 1.40, and the coloring power was evaluated to be good.

C: The image density was in the range of 1.20 or more and less than 1.30.

D: The image density was less than 1.20.

2. Evaluation of Durability 2-1 Toner Filming on Developing Roller

The magenta process cartridge charged with a toner, the LBP-7700C modified so that the process speed was able to be set to 240 mm/s, and plain paper (A4: 81.4 g/m$^2$) for Canon color laser printers were allowed to stand in the N/N environment for 48 hours.

After images with a print coverage of 1% were continuously formed on 1000 sheets of the plain paper (A4: 81.4 g/m$^2$), a half-tone image with 0.2 mg/cm$^2$ of toner deposited was formed on a sheet of the plain paper. This printing operation was repeated until a defect in an output image was caused by toner filming on the developing roller or until images with a print coverage of 1% were output on 20000 sheets. The durability of the toners was rated based on when toner filming occurred, according to the following criteria. Because it was found that when the degree of compatibility between the crystalline resin and the amorphous resin is high, toner filming on the developing roller is likely to occur, the durability was evaluated using toner filming on the developing roller.

A: There occurred no image defect even when 20000 sheets were output, and thus the durability was excellent.

B: There occurred no image defect even when 18000 sheets were output, and thus the durability was good.

C: There occurred no image defect even when 16000 sheets were output.

D: There occurred an image defect before or when 16000 sheets were output.

3. Evaluation of Low-Temperature Fixability 3-1 Decrease in Density by Rubbing

The magenta process cartridge charged with a toner was allowed to stand in the N/N environment for 48 hours. Using the image forming apparatus LBP-7700C modified so that the fuser was able to operate outside the apparatus, a pattern of 9 square images each measuring 10 mm by 10 mm and uniformly arranged over the entire area of a transfer paper was output as an unfixed image pattern. The amount of toner to be deposited on the transfer paper was set to 0.80 mg/cm$^2$, and the temperature at which the image pattern started being fixed was measured. The transfer paper used was Fox River Bond (90 g/m$^2$). The fuser was removed from LBP-7700C, and an external fuser modified so as to operate outside the laser beam printer was used. For fixing, the fixing temperature was raised from 110° C. in increments of 10° C., and the process speed was set at 240 mm/s.

The fixed image pattern was rubbed at a load of 50 g/cm$^2$ with Silbon paper (Lenz Cleaning Paper "Dasper (R)" manufactured by Ozu Paper Co. Ltd). Then, the low-temperature fixability was evaluated based on the fixing start point defined by the temperature at which the image density was reduced by 20% or less from the density before rubbing, according to the following criteria:

A: The fixing start point was 120° C. or less, and the low-temperature fixability was evaluated to be excellent.

B: The fixing start point was 130° C., and the low-temperature fixability was evaluated to be good.

C: The fixing start point was 140° C.

D: The fixing start point was 150° C. or more.

TABLE 8

| | | Coloring power | Durability | Low-temperature fixability |
|---|---|---|---|---|
| Example 1 | Toner 1 | A (1.45) | A | A (120° C.) |
| Example 2 | Toner 2 | A (1.44) | A | A (120° C.) |
| Example 3 | Toner 3 | A (1.44) | A | A (120° C.) |
| Example 4 | Toner 4 | B (1.32) | B (20000 sheets) | A (120° C.) |
| Example 5 | Toner 5 | B (1.37) | B (19000 sheets) | A (120° C.) |
| Example 6 | Toner 6 | A (1.41) | A | A (120° C.) |
| Example 7 | Toner 7 | C (1.25) | B (19000 sheets) | A (110° C.) |
| Example 8 | Toner 8 | B (1.35) | C (18000 sheets) | A (110° C.) |
| Example 9 | Toner 9 | B (1.31) | B (19000 sheets) | A (120° C.) |
| Example 10 | Toner 10 | A (1.44) | A | A (120° C.) |
| Example 11 | Toner 11 | B (1.38) | B (20000 sheets) | A (120° C.) |
| Example 12 | Toner 12 | A (1.40) | A | A (120° C.) |
| Example 13 | Toner 13 | B (1.34) | A | A (120° C.) |
| Example 14 | Toner 14 | C (1.22) | B (19000 sheets) | A (120° C.) |
| Example 15 | Toner 15 | B (1.30) | B (19000 sheets) | A (120° C.) |
| Example 16 | Toner 16 | A (1.41) | A | A (120° C.) |
| Example 17 | Toner 17 | B (1.37) | A | B (130° C.) |
| Example 18 | Toner 18 | C (1.24) | A | C (140° C.) |
| Example 19 | Toner 19 | A (1.45) | A | A (120° C.) |
| Example 20 | Toner 20 | C (1.28) | C (18000 sheets) | A (120° C.) |
| Example 21 | Toner 21 | B (1.37) | B (19000 sheets) | B (130° C.) |
| Example 22 | Toner 22 | C (1.25) | C (17000 sheets) | C (140° C.) |
| Example 23 | Toner 23 | C (1.21) | C (18000 sheets) | A (120° C.) |
| Example 24 | Toner 31 | A (1.45) | A | A (120° C.) |
| Example 25 | Toner 32 | A (1.44) | A | A (120° C.) |
| Example 26 | Toner 33 | A (1.46) | A | A (120° C.) |
| Example 27 | Toner 34 | C (1.25) | A | B (130° C.) |
| Example 28 | Toner 35 | A (1.48) | B (19000 sheets) | A (120° C.) |
| Comparative Example 1 | Toner 24 | C (1.21) | D (14000 sheets) | A (120° C.) |
| Comparative Example 2 | Toner 25 | D (1.08) | B (19000 sheets) | A (120° C.) |
| Comparative Example 3 | Toner 26 | D (1.18) | D (12000 sheets) | A (120° C.) |
| Comparative Example 4 | Toner 27 | D (1.09) | B (19000 sheets) | A (120° C.) |
| Comparative Example 5 | Toner 28 | D (1.18) | D (13000 sheets) | A (120° C.) |
| Comparative Example 6 | Toner 29 | B (1.32) | A | D (150° C.) |
| Comparative Example 7 | Toner 30 | C (1.26) | D (12000 sheets) | A (120° C.) |
| Comparative Example 8 | Toner 36 | D (1.18) | A | C (140° C.) |

Production Example of Toner 101

Styrene: 60.0 parts

C.I. Pigment Red 122 (Chromofine Magenta 6886 (product name)): 8.0 parts

These materials were added into an attritor (manufactured by Nippon Coke & Engineering) and then dispersed in each other at 220 rpm for 5 hours with zirconia grains of 1.7 mm in diameter to yield a pigment dispersion liquid. To the resulting pigment dispersion liquid were added the following materials:

Styrene: 14.1 parts n-Butyl acrylate: 20.9 parts

Amorphous resin 23: 5.0 parts

Behenyl behenate: 8.0 parts

These materials were kept at 65° C. and uniformly dissolved or dispersed in each other with T. K. homomixer at 500 rpm. In the resulting mixture was dissolved 4.4 parts of t-butylperoxy-2-ethyl hexanoate PERBUTYL O (product name) to yield a polymerizable monomer composition.

Meanwhile, 850 parts of 0.1 mol/L $Na_3PO_4$ aqueous solution and 8.0 parts of 10% hydrochloric acid solution were added to a container equipped with a high-speed agitator CLEARMIX set to a rotational speed of 15000 rpm and were then heated to 60° C. Into this container was added 68 parts of 1.0 mol/L $CaCl_2$ aqueous solution to prepare an aqueous medium containing calcium phosphate. Five minutes after the above operation of adding the polymerization initiator, or PERBUTYL O, was added to the polymerizable monomer composition, the polymerizable monomer composition of 60° C. was added into the aqueous medium heated to 60° C. The mixture was subjected to granulation with CLEARMIX at 15000 rpm for 15 minutes. Then, the high-speed agitator was replaced with a propeller stirring blade, and the sample was subjected to a reaction at 60° C. for 5 hours while being refluxed, and then at a liquid temperature of 80° C. for another 5 hours. After the completion of polymerization, the reaction liquid was cooled to about 20° C., and the pH of the aqueous medium was adjusted to 3.0 or less with dilute hydrochloric acid to dissolve the poorly water-soluble dispersant. Furthermore, the reaction product was washed and dried to yield toner particles.

Then, 2.0 parts of silica fine particles (number average particle size of primary particles: 10 nm, BET specific surface area: 170 $m^2/g$) was added as an external additive to 100.0 parts of the resulting toner particles, and the particles were mixed with a HENSCHEL MIXER (manufactured by Nippon Coke & Engineering) at 3000 rpm for 15 minutes to yield Toner 101. The silica fine particles had been hydrophobized with dimethyl silicone oil (20 mass %) and would be triboelectrically charged to the same polarity (negative) as toner particles. The physical properties of Toner 101 are shown in Table 9.

Production Examples of Toners 102 to 118, 127 to 129, and 132

Toners 102 to 118, 127 to 129, and 132 were produced in the same manner as Toner 101, except that the combination of the materials was changed according to Table 9. The physical properties of Toners 102 to 118, 127 to 129, and 132 are shown in Table 9.

Production Example of Toner 119

A dissolution suspension toner was produced in the following process.

Preparation Example of Releasing Agent Dispersion Liquid 4

Into 100.0 parts of methanol was added 100.0 parts of behenyl behenate pulverized to an average particle size of 20 μm, and thus the behenyl behenate was washed at a rotational speed of 150 rpm for 10 minutes, followed by being separated out through a filter. After repeating this operation three times, a wax was separated out through a filter and dried.

Into an attritor (manufactured by Nippon Coke & Engineering) containing zirconia beads of 20 mm in diameter were added 100.0 parts of the resulting wax and 100.0 parts of ethyl acetate, and the materials were dispersed in each other at 150 rpm for 2 hours. The zirconia beads were removed to yield releasing agent dispersion liquid 4.

Preparation Example of Coloring Agent Dispersion Liquid 2

C.I. Pigment Red 122 (Chromofine Magenta 6886 (product name)): 20.0 parts

Ethyl acetate: 80.0 parts

These materials were added into an attritor (manufactured by Nippon Coke & Engineering) containing zirconia beads of 1.7 mm in diameter and dispersed in each other at a rotational speed of 200 rpm for 5 hours. The zirconia beads were removed to yield coloring agent dispersion liquid 2.

Production Example of Toner

Binder resin styrene-n-butyl acrylate copolymer: 95.0 parts
(styrene:n-butyl acrylate ratio=78.0:22.0, Mp=22000, Mw=35000, Mw/Mn=2.4, Tg=55° C.)

Amorphous resin 23: 5.0 parts

Wax dispersion liquid 4: 16.0 parts

Coloring agent dispersion liquid 2: 40.0 parts

These materials were uniformly mixed to prepare a toner composition.

Meanwhile, 850 parts of 0.1 mol/L $Na_3PO_4$ aqueous solution and 8.0 parts of 10% hydrochloric acid solution were added to a container equipped with a high-speed agitator CLEARMIX set to a rotational speed of 15000 rpm and were then heated to 60° C. Into this container was added 68 parts of 1.0 mol/L $CaCl_2$ aqueous solution to prepare an aqueous medium containing calcium phosphate.

With the aqueous medium kept at a temperature of 30° C. and a rotational speed of 15000 rpm, the above-prepared toner composition was added to this aqueous medium and subjected to granulation for 2 minutes. Then, 500 parts of ion exchanged water was added. The agitator was replaced with a propeller stirring blade set to a rotational speed of 150 rpm, and the container was evacuated to 52 kPa with the aqueous medium kept at a temperature of 30° C. to 35° C. so that ethyl acetate was removed to a residual content of 200 ppm.

Subsequently, the aqueous medium was heated to 80° C. and heat-treated at 80° C. for 30 minutes. Then, the aqueous medium was cooled to 25° C. at a rate of 0.15° C./min. With the internal temperature kept from 20.0° C. to 25.0° C., dilute hydrochloric acid was added to the aqueous medium to dissolve the poorly water-soluble dispersant. Furthermore, the reaction product was washed and dried to yield toner particles. An external additive was added to the resulting toner particles in the same manner as in the production example of Toner 101, and thus Toner 119 was produced. The physical properties of Toner 119 are shown in Table 9.

Production Example of Toner 120

Toner 120 was produced in the same manner as Toner 119, except that the wax, or behenyl behenate, was replaced with pentaerythritol tetrabehenate. The physical properties of Toner 120 are shown in Table 9.

Production Example of Toner 121

Toner 121 was produced in the same manner as Toner 119, except that the amount of the binder resin and the amount of amorphous resin 23 were each changed to 50.0 parts. The physical properties of Toner 121 are shown in Table 9.

Production Example of Toner 122

Toner 122 was produced in the same manner as Toner 119, except that the amount of the binder resin and the amount of amorphous resin 23 were changed to 30.0 parts and 70.0 parts, respectively. The physical properties of Toner 122 are shown in Table 9.

Production Example of Toner 123

An emulsion aggregation toner was produced in the following process.

Amorphous resin dispersion liquid 1: 655 parts
Coloring agent dispersion liquid: 52 parts
Releasing agent dispersion liquid 1: 130 parts
Ion exchanged water: 325 parts
Anionic surfactant Dowfax 2A1 (produced by Dow): 6.5 parts These materials were added into a 3 L reaction vessel equipped with a thermometer, a pH meter and a stirrer, and the pH of the mixture was adjusted to 3.0 with 0.3 M of nitric acid at 25° C. Then, 130 parts of 0.3 mass % aluminum sulfate aqueous solution was added to the mixture while the materials were dispersed in each other with a homogenizer ULTRA-TURRAX T50 (manufactured by IKA) at 5,000 rpm, followed by dispersing for another 6 minutes.

Subsequently, the reaction vessel was equipped with a stirrer and a mantle heater and was then heated up to a temperature of 40° C. at a rate of 0.2° C./min while the rotational speed was being adjusted so that the slurry was sufficiently stirred. When the temperature was increased to more than 40° C., the heating rate was varied to 0.05° C./min, and the particle size was measured every 10 minutes. As the volume average particle size came to 5.0 μm, the temperature was held constant, and 350 parts of amorphous resin dispersion liquid 1 was added into the reaction vessel over a period of 5 minutes.

The reaction vessels was allowed to stand for 30 minutes after the addition of amorphous resin dispersion liquid 1, and then the pH of the reaction system was adjusted to 9.0 with 4 mass % sodium hydroxide aqueous solution. The reaction system was then heated up to 90° C. at a rate of 1° C./min while the pH was adjusted to 9.0 every increase in temperature by 50° C., and was kept at 90° C. for 2.0 hours. Then, the vessel was cooled with cold water to 30° C. over a period of 5 minutes.

After cooling, the slurry was passed through a nylon mesh filter of 15 μm in openings to remove coarse particles. The toner slurry that had passed through the mesh filter was adjusted to a pH of 6.0 with nitric acid and then filtered under reduced pressure with an aspirator. The toner remaining on the filter was crush as small as possible and added to ion exchanged water of 10 times the amount of the toner at 30° C. After stirring for 30 minutes, the sample was filtered again under reduced pressure with an aspirator, and the electrical conductivity of the filtrate was measured. This operation was repeated until the electrical conductivity of the filtrate is reduced to 10 μS/cm or less, and thus the resulting toner was washed.

The toner was then finely pulverized with a wet dry granulator and vacuum-dried in an oven of 35° C. for 36 hours to yield washed toner particles. An external additive was added to the resulting toner particles in the same manner as in the production example of Toner 101, and thus Toner 123 was produced. The physical properties of Toner 123 are shown in Table 9.

Production Example of Toner 124

Toner 124 was produced in the same manner as Toner 123, except that amorphous resin dispersion liquid 1 (655 parts) and releasing agent dispersion liquid 1 were replaced with a combination of amorphous resin dispersion liquid 2 (300 parts) and amorphous resin dispersion liquid 3 (355 parts) and releasing agent dispersion liquid 2, respectively. The physical properties of Toner 124 are shown in Table 9.

Production Example of Toner 125

Toner 125 was produced in the same manner as Toner 123, except that amorphous resin dispersion liquid 1 and releasing agent dispersion liquid 1 were replaced with amorphous resin dispersion liquid 3 and release agent dispersion liquid 2, respectively. The physical properties of Toner 125 are shown in Table 9.

Production Example of Toner 126

Toner 126 was produced in the same manner as Toner 125, except that releasing agent dispersion liquid 2 was replaced with release agent dispersion liquid 3. The physical properties of Toner 126 are shown in Table 9.

Production Example of Toner 130

Toner 130 was produced in the same manner as Toner 126, except that amorphous resin dispersion liquid 3 was replaced with amorphous resin dispersion liquid 4. The physical properties of Toner 130 are shown in Table 9.

Production Example of Toner 131

Toner 131 was produced in the same manner as Toner 123, except that amorphous resin dispersion liquid 1 was replaced with amorphous resin dispersion liquid 5. The physical properties of Toner 131 are shown in Table 9.

TABLE 9

| | Amorphous resin | | Monomer | | Wax | | | |
|---|---|---|---|---|---|---|---|---|
| Toner | Type | Percentage in resin composition | Styrene | BA | Type | Parts | Process | D4 (μm) |
| 101 | Amorphous resin 23 | 5.0% | 74.1 | 20.9 | Behenyl behenate | 8.0 | Suspension polymerization | 6.2 |
| 102 | Amorphous resin 24 | 5.0% | 74.1 | 20.9 | Behenyl behenate | 8.0 | Suspension polymerization | 6.0 |
| 103 | Amorphous resin 25 | 5.0% | 74.1 | 20.9 | Behenyl behenate | 8.0 | Suspension polymerization | 6.2 |
| 104 | Amorphous resin 26 | 5.0% | 74.1 | 20.9 | Behenyl behenate | 8.0 | Suspension polymerization | 6.2 |
| 105 | Amorphous resin 27 | 5.0% | 74.1 | 20.9 | Behenyl behenate | 8.0 | Suspension polymerization | 6.4 |
| 106 | Amorphous resin 28 | 5.0% | 74.1 | 20.9 | Behenyl behenate | 8.0 | Suspension polymerization | 6.5 |
| 107 | Amorphous resin 29 | 5.0% | 74.1 | 20.9 | Behenyl behenate | 8.0 | Suspension polymerization | 6.3 |

TABLE 9-continued

| Toner | Amorphous resin Type | Percentage in resin composition | Monomer Styrene | Monomer BA | Wax Type | Wax Parts | Process | D4 (μm) |
|---|---|---|---|---|---|---|---|---|
| 108 | Amorphous resin 30 | 5.0% | 74.1 | 20.9 | Paraffin wax | 8.0 | Suspension polymerization | 6.2 |
| 109 | Amorphous resin 31 | 5.0% | 74.1 | 20.9 | Behenyl Sebacate | 8.0 | Suspension polymerization | 6.1 |
| 110 | Amorphous resin 32 | 5.0% | 74.1 | 20.9 | Fischer-Tropsch wax | 8.0 | Suspension polymerization | 6.2 |
| 111 | Amorphous resin 33 | 5.0% | 74.1 | 20.9 | Behenyl behenate | 8.0 | Suspension polymerization | 5.9 |
| 112 | Amorphous resin 34 | 0.8% | 77.4 | 21.8 | Behenyl behenate | 8.0 | Suspension polymerization | 6.1 |
| 113 | Amorphous resin 35 | 2.0% | 76.4 | 21.6 | Behenyl behenate | 8.0 | Suspension polymerization | 6.2 |
| 114 | Amorphous resin 36 | 5.0% | 74.1 | 20.9 | Behenyl behenate | 30.0 | Suspension polymerization | 6.3 |
| 115 | Amorphous resin 37 | 5.0% | 74.1 | 20.9 | Behenyl behenate | 1.5 | Suspension polymerization | 6.1 |
| 116 | Amorphous resin 38 | 5.0% | 74.1 | 20.9 | Behenyl behenate | 8.0 | Suspension polymerization | 6.2 |
| 117 | Amorphous resin 23 | 5.0% | 74.1 | 20.9 | Behenyl behenate | 35.0 | Suspension polymerization | 6.4 |
| 118 | Amorphous resin 23 | 5.0% | 74.1 | 20.9 | Behenyl behenate | 0.8 | Suspension polymerization | 6.0 |
| 119 | Amorphous resin 23 | 5.0% | — | — | Behenyl behenate | 8.0 | dissolution suspension | 6.2 |
| 120 | Amorphous resin 23 | 5.0% | — | — | Pentaerythritol tetrabehenate | 8.0 | dissolution suspension | 6.2 |
| 121 | Amorphous resin 23 | 50.0% | — | — | Behenyl behenate | 8.0 | dissolution suspension | 6.2 |
| 122 | Amorphous resin 23 | 70.0% | — | — | Behenyl behenate | 8.0 | dissolution suspension | 6.1 |
| 123 | Amorphous resin 39 | 100% | — | — | Fischer-Tropsch wax | 12.9 | Emulsion aggregation | 6.0 |
| 124 | Amorphous resin 40 | 70.0% | — | — | Behenyl behenate | 12.9 | Emulsion aggregation | 6.1 |
| 125 | Amorphous resin 40 | 100% | — | — | Behenyl behenate | 12.9 | Emulsion aggregation | 6.0 |
| 126 | Amorphous resin 40 | 100% | — | — | Pentaerythritol tetrabehenate | 12.9 | Emulsion aggregation | 6.1 |
| 127 | Amorphous resin 41 | 5.0% | 74.1 | 20.9 | Behenyl behenate | 8.0 | Suspension polymerization | 6.2 |
| 128 | Amorphous resin 42 | 5.0% | 74.1 | 20.9 | Behenyl behenate | 8.0 | Suspension polymerization | 6.5 |
| 129 | Amorphous resin 43 | 5.0% | 74.1 | 20.9 | Behenyl behenate | 8.0 | Suspension polymerization | 5.9 |
| 130 | Amorphous resin 44 | 100% | — | — | Pentaerythritol tetrabehenate | 12.9 | Emulsion aggregation | 6.0 |
| 131 | Amorphous resin 45 | 100% | — | — | Fischer-Tropsch wax | 12.9 | Emulsion aggregation | 6.1 |
| 132 | Amorphous resin 46 | 13.0% | 67.9 | 19.1 | Behenyl behenate | 6.1 | Suspension polymerization | 6.2 |

Examples 101 to 126, Comparative Examples 101 to 106

Toners 101 to 132 were evaluated as shown in Tables 10 and 11. The results are shown in Tables 10 and 11.

Each toner was evaluated and rated as below.

For the evaluations, the combination of a modified commercially available laser printer LBP-7700C and a commercially available process cartridge Toner Cartridge 323 (magenta, manufactured by Canon) was used as an image forming apparatus. The original toner product was removed from the cartridge. After being cleaned by blowing air, the cartridge was charged with 150 g of toner of any one of the Examples and Comparative Examples. For the yellow, cyan and black stations, the original toner product was removed from each of the yellow, cyan and black cartridges, and the mechanism for detecting the amount of remaining toner was turned invalid in each cartridge.

1. Evaluation of Color Gamut

The process cartridge charged with a toner was allowed to stand in an environment of room temperature (23° C.) and normal humidity (50% RH) (hereinafter referred to as N/N environment) for 48 hours. Using the image forming apparatus LBP-7700C modified so that the fuser was able to operate outside the apparatus, a pattern of 9 square images each measuring 10 mm by 10 mm and uniformly arranged over the entire area of a transfer paper GF-C081 (A4, 81.4 g/m$^2$, manufactured by Canon) was output as an unfixed image pattern. The image pattern was formed on 11 sheets of the transfer paper while the amount of toner to be deposited was varied from 0.25 mg/cm$^2$ to 0.75 mg/cm$^2$ in increments of 0.05 mg/cm$^2$. The fuser was removed from LBP-7700C, and an external fuser modified so as to operate outside the laser beam printer was used. The output image pattern was fixed at a temperature of 160° C. and a process speed of 240 mm/s.

The chroma (C*) of the 10 mm×10 mm square images was measured with Spectrolino (manufactured by Macbeth) in accordance with the instruction manual supplied with the meter. The measured chromas of the 9 square images on each sheet were averaged, and the averaged value was used as the chroma of the sheet. The highest chroma of the 11 sheets was rated for evaluation according to the following criteria:

A: The chroma was 80 or more, and the color gamut was evaluated to be excellent.

B: The chroma was in the range of from 77 to less than 80, and the color gamut was evaluated to be good.

C: The chroma was in the range of from 74 to less than 77.

D: The chroma was less than 74.

2. Evaluation of Durability

The process cartridge charged with a toner, the LBP-7700C modified so that the process speed was able to be set to 240 mm/s, and a transfer paper GF-C081 were allowed to stand in the N/N environment and low-temperature low-humidity environment (15° C., 10% RH) each for 48 hours.

In each environment, images with a print coverage of 1% were output on 1000 sheets of the transfer paper. Then, a solid image with an amount of toner deposited of 0.45 mg/cm$^2$ was output on a sheet of the transfer paper and the developing roller was visually observed for checking for a streak parallel to the rotation direction of the roller (hereinafter referred to as the circumferential streak on the roller). This printing operation was repeated until a streak parallel to the output direction of the image (hereinafter referred to as vertical streak) was formed in the solid image or until images with a print coverage of 1% were output on 20000 sheets.

The durability of the toners was rated based on when the circumferential streak on the developing roller and the vertical streak in the image were formed, according to the following criteria:

A: There occurred no vertical streak in the solid images and no circumferential streak on the developing roller even when 20000 sheets were output, and durability was thus excellent.

B: There occurred no vertical streak in the solid images even when 20000 sheets were output, and there occurred no circumferential streak on the developing roller even when 18000 sheets were output. Durability was thus good.

C: There occurred no vertical streak in the solid image even when 20000 sheets were output, and there occurred no circumferential streak on the developing roller even when 16000 sheets were output.

D: There occurred a vertical streak in a solid image before 20000 sheets were output.

3. Evaluation of Triboelectric Stability

The process cartridge charged with a toner, the LBP-7700C modified so that the process speed was able to be set to 240 mm/s, and a transfer paper GF-C081 were allowed to stand in the N/N environment and high-temperature high-humidity environment (30° C., 80% RH, hereinafter referred to as the H/H environment) each for 48 hours. In each environment, images with a print coverage of 1% were output on 20000 sheets of the transfer paper and allowed to stand in that environment for 48 hours. Then, a solid image was formed on a sheet of transfer paper whose central area measuring 5 cm by 5 cm was masked. The masking cover was removed from the resulting image, and the reflectances of the masked portion and unmasked portion were measured with TC-6DS (manufactured by Tokyo Denshoku). Fogging in the images was estimated and the triboelectric stability of the toners was evaluated based on the fogging.

Fogging (%)=reflectance (%) of masked portion−reflectance (%) of unmasked portion Fogging is caused by poorly charged toner. Accordingly, a toner having lower water absorbency and higher triboelectric stability is less likely to cause fogging under a high-humidity environment.

A: Fogging was 1.0% or less, and the triboelectric stability was evaluated to be excellent.

B: Fogging was in the range of more than 1.0% and 2.0% or less, and the triboelectric stability was evaluated to be good.

C: Fogging was in the range of more than 2.0% and 3.0% or less.

D: Fogging was more than 3.0%.

4. Evaluation of Fixability

The process cartridge charged with a toner was allowed to stand in the N/N environment for 48 hours. Using the image forming apparatus LBP-7700C modified so that the fuser was able to operate outside the apparatus, a pattern of 9 square images each measuring 10 mm by 10 mm and uniformly arranged over the entire area of a transfer paper was output as an unfixed image pattern. The amount of toner to be deposited on the transfer paper was set to 0.70 mg/cm$^2$, and the temperature at which the image pattern started being fixed was measured. The transfer paper used was Fox River Bond (90 g/m$^2$). The fuser was removed from LBP-7700C, and an external fuser modified so as to operate outside the laser beam printer was used. The output image pattern was fixed at a process speed of 240 mm/s in a state where the fixing temperature was able to be arbitrarily set.

The fixed image pattern was rubbed at a load of 50 g/cm$^2$ with Silbon paper (Lenz Cleaning Paper "Dasper (R)" manufactured by Ozu Paper Co. Ltd). Then, the low-temperature fixability was evaluated based on the fixing start point defined by the temperature at which the image density was reduced by 20% or less from the density before rubbing, according to the following criteria:

A: The fixing start point was 120° C. or less, and the low-temperature fixability was evaluated to be excellent.

B: The fixing start point was in the range of more than 120° C. and 130° C. or less, and the low-temperature fixability was evaluated to be good.

C: The fixing start point was in the range of more than 130° C. and 140° C. or less.

D: The fixing start point was more than 140° C.

TABLE 10

| | | Color gamut | | N/N durability (Streak) | | | L/L durability (Streak) | | |
|---|---|---|---|---|---|---|---|---|---|
| | | Chroma | Rating | In image | On roller | Rating | In image | On roller | Rating |
| Example 101 | Toner 101 | 81 | A | None | None | A | None | None | A |
| Example 102 | Toner 102 | 79 | B | None | None | A | None | None | A |
| Example 103 | Toner 103 | 81 | A | None | None | A | None | None | A |
| Example 104 | Toner 104 | 81 | A | None | None | A | None | None | A |
| Example 105 | Toner 105 | 81 | A | None | None | A | None | None | A |
| Example 106 | Toner 106 | 77 | B | None | None | A | None | None | A |
| Example 107 | Toner 107 | 79 | B | None | None | A | None | None | A |
| Example 108 | Toner 108 | 81 | A | None | None | A | None | None | A |
| Example 109 | Toner 109 | 81 | A | None | None | A | None | None | A |
| Example 110 | Toner 110 | 81 | A | None | None | A | None | None | A |
| Example 111 | Toner 111 | 82 | A | None | None | A | None | 20000 sheets | B |
| Example 112 | Toner 112 | 78 | B | None | None | A | None | 20000 sheets | B |
| Example 113 | Toner 113 | 80 | A | None | None | A | None | None | A |
| Example 114 | Toner 114 | 80 | A | None | None | A | None | None | A |
| Example 115 | Toner 115 | 81 | A | None | None | A | None | None | A |
| Example 116 | Toner 116 | 81 | A | None | None | A | None | None | A |
| Example 117 | Toner 117 | 77 | B | None | None | A | None | 20000 sheets | B |
| Example 118 | Toner 118 | 81 | A | None | None | A | None | None | A |
| Example 119 | Toner 119 | 81 | A | None | None | A | None | None | A |
| Example 120 | Toner 120 | 75 | C | None | None | A | None | None | A |
| Example 121 | Toner 121 | 81 | A | None | None | A | None | None | A |
| Example 122 | Toner 122 | 81 | A | None | None | A | None | 20000 sheets | B |
| Example 123 | Toner 123 | 81 | A | None | 20000 sheets | B | None | 18000 sheets | C |

TABLE 10-continued

| | | Color gamut | | N/N durability (Streak) | | | L/L durability (Streak) | | |
|---|---|---|---|---|---|---|---|---|---|
| | | Chroma | Rating | In image | On roller | Rating | In image | On roller | Rating |
| Example 124 | Toner 124 | 77 | B | None | 20000 sheets | B | None | 19000 sheets | B |
| Example 125 | Toner 125 | 77 | B | None | 19000 sheets | B | None | 17000 sheets | C |
| Example 126 | Toner 126 | 74 | C | None | 19000 sheets | B | None | 17000 sheets | C |
| Comparative Example 101 | Toner 127 | 72 | D | 20000 sheets | 16000 sheets | D | 18000 sheets | 14000 sheets | D |
| Comparative Example 102 | Toner 128 | 74 | D | None | None | A | None | None | A |
| Comparative Example 103 | Toner 129 | 82 | A | 20000 sheets | 16000 sheets | D | 18000 sheets | 14000 sheets | D |
| Comparative Example 104 | Toner 130 | 71 | D | None | 20000 sheets | B | None | 17000 sheets | C |
| Comparative Example 105 | Toner 131 | 71 | D | 20000 sheets | 16000 sheets | D | 18000 sheets | 14000 sheets | D |
| Comparative Example 106 | Toner 132 | 74 | D | 20000 sheets | 16000 sheets | D | 18000 sheets | 14000 sheets | D |

TABLE 11

| | | N/N chargeability (Fogging) | | H/H chargeability (Fogging) | | Fixability (Rubbing) | |
|---|---|---|---|---|---|---|---|
| | | Value | Rating | Value | Rating | Fixing temperature | Rating |
| Example 101 | Toner 101 | 0.2 | A | 0.4 | A | 115° C. | A |
| Example 102 | Toner 102 | 0.4 | A | 0.7 | A | 115° C. | A |
| Example 103 | Toner 103 | 0.3 | A | 0.5 | A | 115° C. | A |
| Example 104 | Toner 104 | 0.4 | A | 0.7 | A | 115° C. | A |
| Example 105 | Toner 105 | 0.5 | A | 1.1 | B | 115° C. | A |
| Example 106 | Toner 106 | 0.3 | A | 0.5 | A | 130° C. | B |
| Example 107 | Toner 107 | 0.4 | A | 0.6 | A | 120° C. | A |
| Example 108 | Toner 108 | 0.2 | A | 0.4 | A | 115° C. | A |
| Example 109 | Toner 109 | 0.3 | A | 0.5 | A | 115° C. | A |
| Example 110 | Toner 110 | 0.2 | A | 0.4 | A | 115° C. | A |
| Example 111 | Toner 111 | 0.4 | A | 0.7 | A | 115° C. | A |
| Example 112 | Toner 112 | 0.2 | A | 0.4 | A | 115° C. | A |
| Example 113 | Toner 113 | 0.4 | A | 0.6 | A | 115° C. | A |
| Example 114 | Toner 114 | 0.3 | A | 0.5 | A | 110° C. | A |
| Example 115 | Toner 115 | 0.4 | A | 0.6 | A | 115° C. | A |
| Example 116 | Toner 116 | 0.5 | A | 0.9 | A | 115° C. | A |
| Example 117 | Toner 117 | 0.5 | A | 1.1 | B | 110° C. | A |
| Example 118 | Toner 118 | 0.2 | A | 0.4 | A | 125° C. | B |
| Example 119 | Toner 119 | 0.7 | A | 1.7 | B | 115° C. | A |
| Example 120 | Toner 120 | 0.7 | A | 1.6 | B | 125° C. | B |
| Example 121 | Toner 121 | 0.7 | A | 1.6 | B | 120° C. | A |
| Example 122 | Toner 122 | 0.6 | A | 1.2 | B | 125° C. | B |
| Example 123 | Toner 123 | 0.9 | A | 2.3 | C | 130° C. | B |
| Example 124 | Toner 124 | 0.8 | A | 2.1 | C | 125° C. | B |
| Example 125 | Toner 125 | 0.9 | A | 2.5 | C | 125° C. | B |
| Example 126 | Toner 126 | 0.9 | A | 2.7 | C | 135° C. | C |
| Comparative Example 101 | Toner 127 | 1.1 | B | 3.3 | D | 115° C. | A |
| Comparative Example 102 | Toner 128 | 0.2 | A | 0.5 | A | 140° C. | C |
| Comparative Example 103 | Toner 129 | 0.5 | A | 0.8 | A | 115° C. | A |
| Comparative Example 104 | Toner 130 | 0.9 | A | 2.7 | C | 140° C. | C |
| Comparative Example 105 | Toner 131 | 1.2 | B | 3.4 | D | 135° C. | C |
| Comparative Example 106 | Toner 132 | 1.2 | B | 3.1 | D | 115° C. | A |

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2015-035864 filed Feb. 25, 2015, which is hereby incorporated by reference herein in its entirety.

What is claimed is:

1. A toner comprising a toner particle containing:

a binder resin, a pigment, a crystalline resin, and an amorphous resin, wherein, an adsorption rate A1 of the crystalline resin to the pigment is from 5% to 40%, an adsorption rate A2 of the amorphous resin to the pigment is from 20% to 60%, and the adsorption rates A1 and A2 satisfy the following relationship: A1<A2 (1), wherein, in the relationship (1), A1 represents an adsorption rate measured for a mixture obtained by mixing 0.1 mass part of the crystalline resin, 1.0 mass part of the pigment, and 20 mass part of a solvent in which 16 mass parts of styrene and 4 mass parts of n-butyl acrylate are mixed, and A2 represents an adsorption rate measured for a mixture obtained by mixing 0.1 mass part of the amorphous resin, 1.0 mass part of the pigment, and 20 mass parts of a solvent in which 16 mass parts of styrene and 4 mass parts of n-butyl acrylate are mixed, and a degree of compatibility represented by the following equation (2) is 70% or less:

$$\text{degree of compatibility (\%)}=(1-B1/B2)\times 100 \quad (2),$$

wherein, in equation (2),

B1 represents an exothermic quantity per gram (J/° C.) of the crystalline resin at an exothermic peak derived from crystallization of the crystalline resin, measured with a differential scanning calorimeter in a secondly cooling step of a process including: heating a resin mixture from 30° C. to 200° C., the resin mixture containing the amorphous resin and the crystalline resin with a mass ratio of 9:1, subsequently cooling the resin mixture from 200° C. to 0° C., subsequently heating the resin mixture from 0° C. to 120° C., then keeping the resin mixture at 120° C. for 5 minutes, and secondly cooling the resin mixture from 120° C. to 0° C., and B2 represents an exothermic quantity per unit gram (J/° C.) of the crystalline resin at an exothermic peak derived from crystallization of the crystalline resin, measured with a differential scanning calorimeter in a secondly cooling step of a process including: heating the crystalline resin alone from 30° C. to 200° C., subsequently cooling the crystalline resin from 200° C. to 0° C., subsequently heating the crystalline resin from 0° C. to 120° C., then keeping the crystalline resin at 120° C. for 5 minutes, and secondly cooling the resin mixture from 120° C. to 0° C., wherein the heating and the cooling in the processes for measuring B1 and B2 are each performed at a rate of 10° C./min.

2. The toner according to claim 1, wherein the amorphous resin is a polyester resin.

3. The toner according to claim 2, wherein the polyester resin has a unit derived from an alcohol having an alicyclic structure or a unit derived from a carboxylic acid having an alicyclic structure, in at least one selected from the group consisting of the main chain and a side chain thereof.

4. The toner according to claim 3, wherein the ratio of the amount by mole of the unit derived from an alcohol having an alicyclic structure or a carboxylic acid having an alicyclic structure to the amount by mole of all the units of the polyester resin is in the range of from 0.1% to 50%.

5. The toner according to claim 3, wherein the unit derived from an alcohol having an alicyclic structure or a carboxylic acid having an alicyclic structure is a unit derived from a compound expressed by any one of the following formulas (A-1) to (A-5):

(A-1)

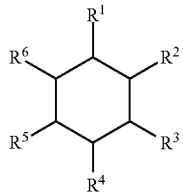

(A-2)

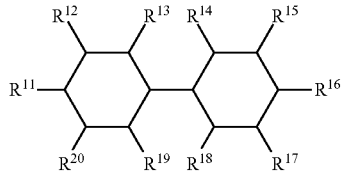

(A-3)

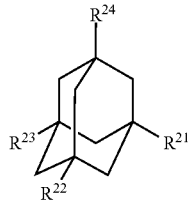

(A-4)

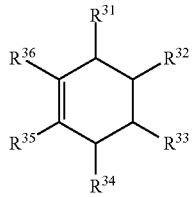

(A-5)

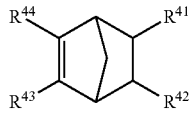

wherein in formula (A-1), at least two of $R^1$ to $R^6$ each represent —OH, —COOH, —$R^7$—OH, or —$R^8$—COOH, and the —COOH and —$R^8$—COOH groups each may be any one of a halogenated acyl, an ester and an acid anhydride that are derived from the carboxy group thereof, or may be in the form of an acid anhydride in the molecule; the rest of $R^1$ to $R^6$ each represent a hydrogen atom, a halogen atom, or an alkyl group; and $R^7$ and $R^8$ represent alkylene groups, wherein in formula (A-2), at least two of $R^{11}$ to $R^{20}$ each represent —OH, —COOH, —$R^9$—OH, or —$R^{10}$—COOH, and the —COOH and —$R^{10}$—COOH groups each may be any one of a halogenated acyl, an ester and an acid anhydride that are derived from the carboxy group thereof, or may be in the form of an acid anhydride in the molecule; the rest of $R^{11}$ to $R^{20}$ each represent a hydrogen atom, a halogen atom, or an alkyl group; and $R^9$ and $R^{10}$ represent alkylene groups, wherein in formula (A-3), at least two of $R^{21}$ to $R^{24}$ each represent —OH, —COOH, —$R^{25}$—OH, or —$R^{26}$—COOH, and the —COOH and —$R^{26}$—COOH groups each may be any one of a halogenated acyl, an ester and an acid anhydride that are derived from the carboxy group thereof, or may be in the form of an acid anhydride in the molecule; the rest of $R^{21}$ to $R^{24}$ each represent a hydrogen atom, a halogen atom, or an alkyl group; and $R^{25}$ and $R^{26}$ represent alkylene groups, wherein in formula (A-4), at least two of $R^{31}$ to $R^{36}$ each represent —OH, —COOH, —$R^{37}$—OH, or —$R^{38}$—COOH, and the —COOH and —$R^{38}$—COOH groups each may be any one of a halogenated acyl, an ester and an acid anhydride that are derived from the carboxy group thereof, or may be in the form of an acid anhydride in the molecule; the rest of $R^{31}$ to $R^{36}$ each represent a hydrogen atom, a halogen atom, or an alkyl group; and $R^{37}$ and $R^{38}$ represent alkylene groups, and wherein in formula (A-5), at least two of $R^{41}$ to $R^{44}$ each represent —OH, —COOH, —$R^{45}$—OH, or —$R^{46}$—COOH, and the —COOH and —$R^{46}$—COOH groups each may be any one of a halogenated acyl, an ester and an acid anhydride that are derived from the carboxy group thereof, or may be in the form of an acid anhydride in the molecule; the rest of $R^{41}$ to $R^{44}$ each represent a hydrogen atom, a halogen atom, or an alkyl group; and $R^{45}$ and $R^{46}$ represent alkylene groups.

6. The toner according to claim 5, wherein the unit derived from an alcohol having an alicyclic structure or a carboxylic acid having an alicyclic structure is a unit derived from a compound expressed by formula (A-3).

7. The toner according to claim 5, wherein the compound expressed by formula (A-3) is 1,3-adamantanediol or 1,3-adamantanedicarboxylic acid.

8. The toner according to claim 1, wherein the adsorption rates A1 and A2 satisfy the following relationship:

$$10 \leq A2 - A1 \leq 55 \quad (3).$$

9. The toner according to claim 1, wherein the degree of compatibility expressed by equation (2) is in the range of from 0% to 60%.

10. The toner according to claim 1, wherein the adsorption rate A2 is in the range of from 20% to 50%.

11. The toner according to claim 1, wherein the binder resin has an adsorption rate A3 to the pigment of 15% or less, wherein A3 represents an adsorption rate measured for a mixture obtained by mixing 0.1 mass part of the binder resin, 1.0 mass part of the pigment, and 20 mass parts of a solvent in which 16 mass parts of styrene and 4 mass parts of n-butyl acrylate are mixed.

12. The toner according to claim 1, wherein the crystalline resin has a weight average molecular weight in the range of from 5000 to 100000.

13. The toner according to claim 1, wherein the crystalline resin is a crystalline polyester resin.

14. The toner according to claim 1, wherein the pigment is a carbon black or a magenta pigment having a quinacridone skeleton.

15. A method for producing the toner comprising a toner particle according to claim 1, the method comprising one of the following steps (A) and (B):

(A) including preparing a suspension for granulation by forming particles of a composition containing a polymerizable monomer, the crystalline resin, the amorphous resin and the pigment in an aqueous medium, and polymerizing the polymerizable monomer in the suspension; and (B) including preparing a resin solution by dissolving or dispersing a binder resin, the crystalline resin, the amorphous resin and the pigment in an organic solvent, granulating the resin solution by dispersing the resin solution in an aqueous medium; and removing the organic solvent from the particles.

16. The method according to claim 15, wherein the toner is produced through step (A).

* * * * *